US005862549A

United States Patent [19]

Morton et al.

[11] Patent Number: 5,862,549

[45] Date of Patent: Jan. 26, 1999

[54] MATERNITY BED

[75] Inventors: Gary Morton, Kalamazoo; Ned Johnson, Bloomingdale, both of Mich.; John Luecke, Milwaukie, Oreg.

[73] Assignee: Stryker Corporation, Kalamazoo, Mich.

[21] Appl. No.: 821,801

[22] Filed: Mar. 19, 1997

Related U.S. Application Data

[63] Continuation-in-part of Ser. No. 583,235, Jan. 5, 1996, Pat. No. 5,774,914.

[51] Int. Cl.[6] ..... A61G 7/012

[52] U.S. Cl. ..... 5/610; 5/611

[58] Field of Search ..... 5/610, 611, 616

[56] References Cited

U.S. PATENT DOCUMENTS

| | | | |
|---|---|---|---|
| 3,336,606 | 8/1967 | Beitzel | 5/610 |
| 3,492,679 | 2/1970 | Drew . | |
| 3,644,945 | 2/1972 | Goodman et al. | 5/616 |
| 4,025,972 | 5/1977 | Adams et al. . | |
| 4,097,939 | 7/1978 | Peck et al. . | |
| 4,139,917 | 2/1979 | Fenwick . | |
| 4,411,035 | 10/1983 | Fenwick . | |
| 4,639,954 | 2/1987 | Speed . | |
| 4,860,394 | 8/1989 | Benessis et al. | 5/611 |
| 4,894,876 | 1/1990 | Fenwick . | |
| 5,143,562 | 9/1992 | Borders et al. | 5/610 |
| 5,148,562 | 9/1992 | Borders et al. . | |
| 5,157,800 | 10/1992 | Borders . | |
| 5,214,812 | 6/1993 | Bartow et al. . | |
| 5,299,334 | 4/1994 | Gonzalez | 5/610 X |
| 5,329,657 | 7/1994 | Bartley et al. . | |
| 5,423,097 | 6/1995 | Brulé et al. . | |
| 5,615,431 | 4/1997 | Vassilli | 5/611 X |

OTHER PUBLICATIONS

Stryker Medical, Labor & Delivery Model 5000 Series, Oct., 1996, 2 pages.

Stryker Adel 2100EC Childbearing Bed, Ultimate convenience and comfort, Jan. 1994, (6 pages).

Stryker Adel 500XL Childbearing Bed, May 1995, (2 pages).

*Primary Examiner*—Michael F. Trettel

*Attorney, Agent, or Firm*—Flynn, Thiel, Boutell & Tanis, P.C.

[57] ABSTRACT

A hospital bed (10) especially adapted for use by a woman giving birth is disclosed. The bed includes a base (11) on which a litter frame (12) is positioned. A lift assembly (14) attached to the base and is connected to a inner frame (50) located inside the litter frame. The lift assembly moves the inner frame and litter frame up and down. The litter frame is pivotally connected to the inner frame so that the litter frame can be selectively moved in the Trendelenburg position.

19 Claims, 21 Drawing Sheets

MATERNITY BED

RELATIONSHIP TO OTHER APPLICATIONS

This application is a continuation-in-part of U.S. patent application Ser. No. 08/583,235, filed Jan. 5, 1996, now U.S. Pat. No. 5,774,914.

FIELD OF THE INVENTION

This invention relates generally to hospital beds and, more particularly, to a maternity bed designed to ease the birthing process for both the mother and the medical personnel that are assisting her.

BACKGROUND OF THE INVENTION

Over the years, the maternity bed on which a woman rests while giving birth has evolved into a useful aid for assisting in the birthing process. A maternity bed includes many of the elements of a conventional hospital bed. The bed has a base that forms the underlying support structure and a litter located above the base that serves as a support frame for the mattress on which the woman rests. Like many other hospital beds, a maternity bed is provided with a lift mechanism that raises and lowers the litter relative to the base. A maternity bed is further constructed so that the portion of the bed that supports the woman's upper body, referred to as the Fowler section, is able to pivot relative to the adjacent section, the seat section. The inclined Fowler section provides back support for the birthing mother so that she can be in an optimal position to facilitate delivery. A maternity bed is also usually provided with foot rests that are selectively positioned for the placement of the woman's feet. The foot rests and inclined Fowler section provide support for the mother so that she can generate muscle contractions along the birth canal that facilitate the delivery. A maternity bed is also usually designed so that the portion of the litter located anatomically below the seat section, referred to as the foot section, can be removed during the delivery process. The enables medical person to position themselves adjacent the open end of the birth canal so that they can provide the necessary assistance to the mother and child.

While current maternity beds have proved useful for facilitating the birthing process, they are not without some disadvantages. In a maternity bed, for example, it is desirable to design the lift mechanism so that the litter can be positioned both as close to the floor as possible and at normal, bed-height. This is because, as part of the delivery process, many women are encouraged to walk as much as possible prior to the commencement of the delivery in order to ease the delivery. The positioning of the bed close to the floor makes getting into and out of the bed a relatively easy task. Problems have arisen because a maternity bed should also be designed to pivot the litter into what is referred to as the Trendelenburg position. When the bed is in this position, the litter is oriented so that the woman's head and upper body are below her waist. It is desirable to pivot the bed into this position if, during the birthing process, the woman develops a cardiac condition and there is a need to ensure blood flow to the brain.

Beds have been provided with mechanisms that make it possible for both lift the litter and pivot it in the Trendelenburg position. However, many of these beds employ a manually actuated linkage for moving the litter into the Trendelenburg position. A disadvantage of this type of bed is that it requires medical personnel to spend time physically pivoting the litter; this takes away from the time available for attending to the woman. There have been attempts to provide beds with motor-driven systems for pivoting the bed into the Trendelenburg position. One disadvantage of these mechanisms is that the required numerous components. Still another disadvantage of some of these systems is that they operate in conjunction with the bed lift assembly and require the litter be lifted to its highest possible position before it can be pivoted into the Trendelenburg state. Clearly, a limitation associated with these beds is that if the litter is not already in full height position, time is lost having to properly position it before it can moved into the Trendelenburg position. The time lost having to raise the litter can, in some instances, be a factor in reducing the adverse effects the woman's medical condition.

Still another drawback of many maternity beds is that while they are provided with pivoting Fowler sections, the Fowler sections are not readily adjustable for women with varying body shapes and sizes. A relatively short woman, for example, may not be able to press her back against the Fowler even if it is in a fully inclined, almost upright, position. Furthermore, when a woman small in stature is positioned so that her back is against the Fowler section, the open end of her birth canal may not be positioned along the rear edge of the seat section, which is typically the optimal position for medical personnel to assist in the delivery process. In contrast, when the Fowler section is inclined, it may be difficult for a relatively tall woman to comfortably and safely be positioned so that her seat section rests firmly on the underlying mattress seat section.

Moreover, some maternity beds are designed so that in order to set their foot rests in position, it is necessary to flip-over and/or remove portions of the leg-and-foot section of the bed under which the foot rests are located. This may require repositioning and/or lifting of the woman's legs to gain access to the foot rests. Sometimes, having to move a woman's legs in order to be able to lift the foot-and-leg portions of a mattress in order to access the foot rests may require the attention of more than one individual. Furthermore, it is common practice to provide a maternity bed not only with foot rests but leg rests designed to hold the woman's legs open during the birthing process. Many of these leg rests are separate units that are installed by placement into complementary coupling mechanisms associated with the foot rests. The time required to place these leg rests in position likewise can sometimes divert medical personnel from more important tasks.

Still another limitation of some maternity beds is that the foot frame, the portion of the litter which supports the foot-and-leg mattress, may be difficult to quickly separate from the other sections of the litter. If there is a need to quickly access the woman's birth canal, medical personnel may lose some time in their efforts to separate this frame and mattress from the other elements of the bed.

SUMMARY OF THE INVENTION

This invention is directed to a new and improved maternity bed designed to facilitate the birthing process for both the mother and the medical personnel assisting in the delivery. The maternity bed of this invention includes a litter frame that is seated on an inner frame that consists of a pair of parallel, spaced apart rails. The inner frame is connected to an underlying bed base section by a lift assembly that raises and lowers both it and the litter frame. The litter frame is pivotally connected to the inner frame so that can be moved from a normal, horizontal, position, to the Trendelenburg position wherein the head and upper body sections of the mattress are below the seat section. This pivoting is performed by a motor-powered drive assembly.

The bed of this invention is further constructed to have a Fowler frame that is on a carriage that is attached to the litter frame. This allows the Fowler frame to be selectively positioned along the longitudinal axis of the litter frame. The foot rests are attached to the litter by linkage assemblies that are pivotally connected to an under surface of the litter. Leg rests are attached to the undersides of the foot rests. The maternity bed of this invention is also provided with a removable foot frame that is normally secured to the litter frame by a quick release latch assembly.

When a woman is ready to rest on the maternity bed of this invention, the lift assembly is actuated to lower the inner frame and litter frame to adjacent the floor. When the bed is in this position, it is a relatively simple task for the woman sit down and lie on the bed. The lift assembly is again actuated to raise the litter frame so that it is a height that is convenient for the medical personnel to attend to the needs of the mother. If, during the birthing process it is necessary to lower this woman's upper body, the litter frame is pivoted around the inner frame to properly position the woman. Since the pivoting is performed by the actuation of a drive assembly rather than manually, medical personnel can attend to the woman rather than to the bed. Moreover, the litter frame need not be in its full height position in order for it to be pivoted into the Trendelenburg position.

When it is time to begin the delivery process, the Fowler frame is pivoted upwards. As part of the Fowler positioning process, the carriage to which the Fowler frame is attached may be selectively moved relative to the seat section of the litter frame. This makes it possible to position the Fowler frame where it will be most useful for the individual woman on the bed. The foot rests are placed in position by the simple act of pivoting them upwardly from their stored positions. When, during the birthing process, it is desirable to place the woman's legs in the leg rests, the leg rests are placed into position by the simple rotation of the foot rests to which they are attached. When medical personnel need to access the birth canal region, the quick release mechanism of the foot frame is actuated. It is then a relatively simple task to simply pull the foot frame away from the litter frame.

Thus, the maternity bed of this invention designed to both facilitate the birthing process of women of varying shapes and sizes to minimize the effort required by medical personnel in order to take advantage of the useful assemblies that form this bed.

BRIEF DESCRIPTION OF THE DRAWINGS

The invention will be pointed out particularly in the claims. The above and further advantages of the invention may be better understood by reference the following detailed description taking in conjunction with the accompanying drawings, in which:

DETAILED DESCRIPTION

Figure 1:
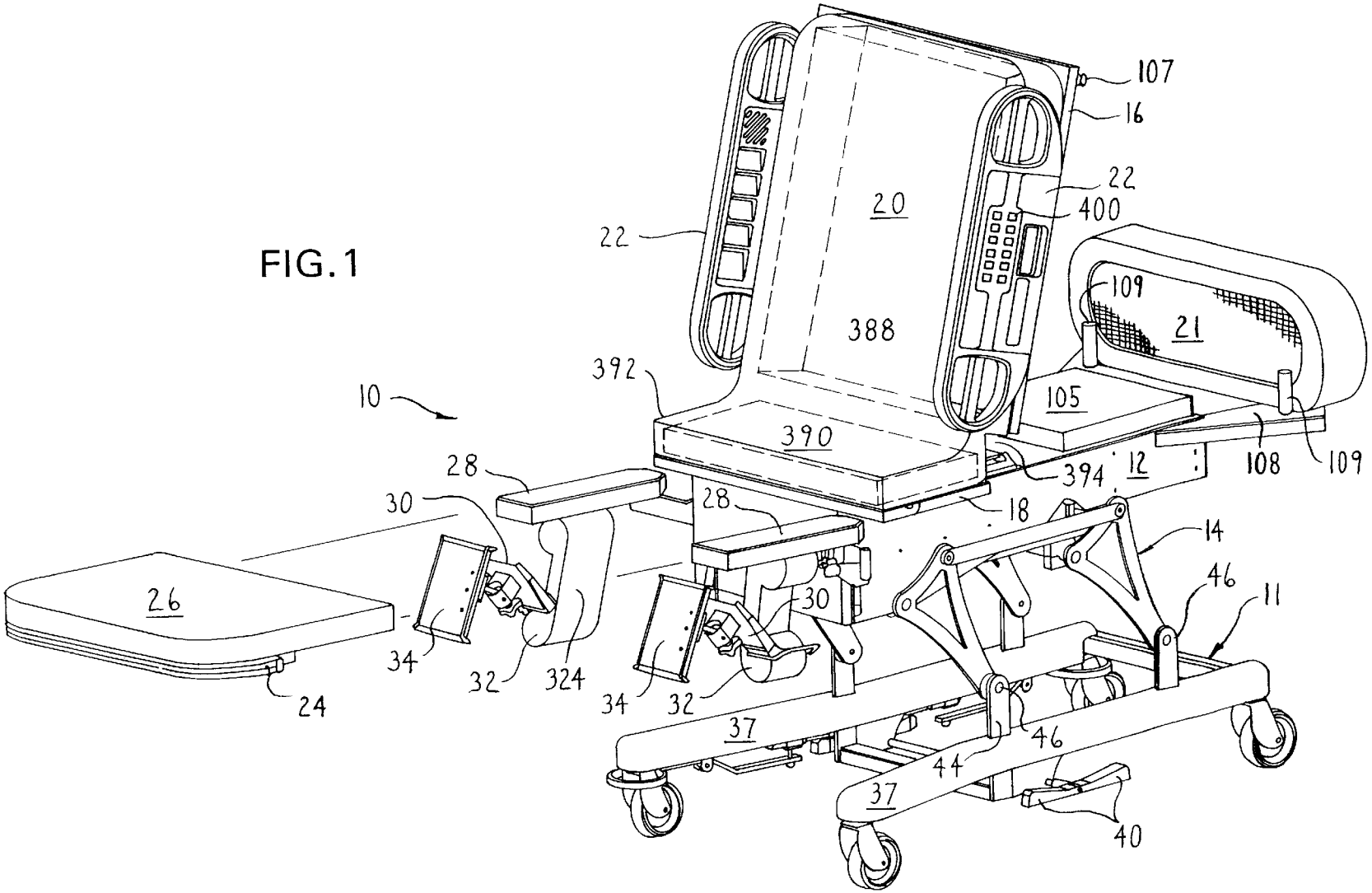
FIG. 1 is a perspective view illustrating the basic features of a maternity bed of this invention.

FIG. 1 illustrates the basic structure of the maternity bed 10 of this invention. Maternity bed 10 includes a base 11 to which a litter frame 12 is attached by a lift assembly 14. A Fowler frame 16 extends over approximately two-thirds the top surface of the litter frame 12. A seat frame 18 covers the remaining one-third of the litter frame 12 and is firmly attached to the litter frame. Fowler frame 16 is attached to the litter frame 12 to both pivot around an axis adjacent to the seat frame 18 and to move along the length of the litter frame so that the pivot axis can be shifted relative to the seat frame 18. A mattress 20 covers the exposed surfaces of the both the Fowler frame 16 and seat frame 18. A head board 21 is attached to the head end of the litter frame 12. Side rails 22 are attached to the side edges of the Fowler frame 16 to prevent the woman from rolling out of the bed 10.

Two foot pans 28 are secured to the litter frame 12 adjacent the seat frame 18 so as to extend rearwardly therefrom. A foot frame 24 is removably attached to the ends of the foot pans 28 adjacent the litter frame 12 so as to have a top surface level with the top surface of the foot pans. A lower mattress 26 is supported by the foot frame 24 and is dimensioned to cover the top surfaces of both the foot frame and of the foot pans 28. Foot rests 30 are secured to the foot pans 28 by pivoting linkages 32. The linkages 32 facilitate the movement of the foot rests 30 from their stowed positions to their in-use positions wherein they are located above the lower mattress 26. A leg rest 34 is attached to the undersurface of each foot rest 30. Each leg rest 34 is secured in position by the pivoting of the associated foot rest 30 around the linkage 32 to which the foot rest 30 is attached.

Figure 2:
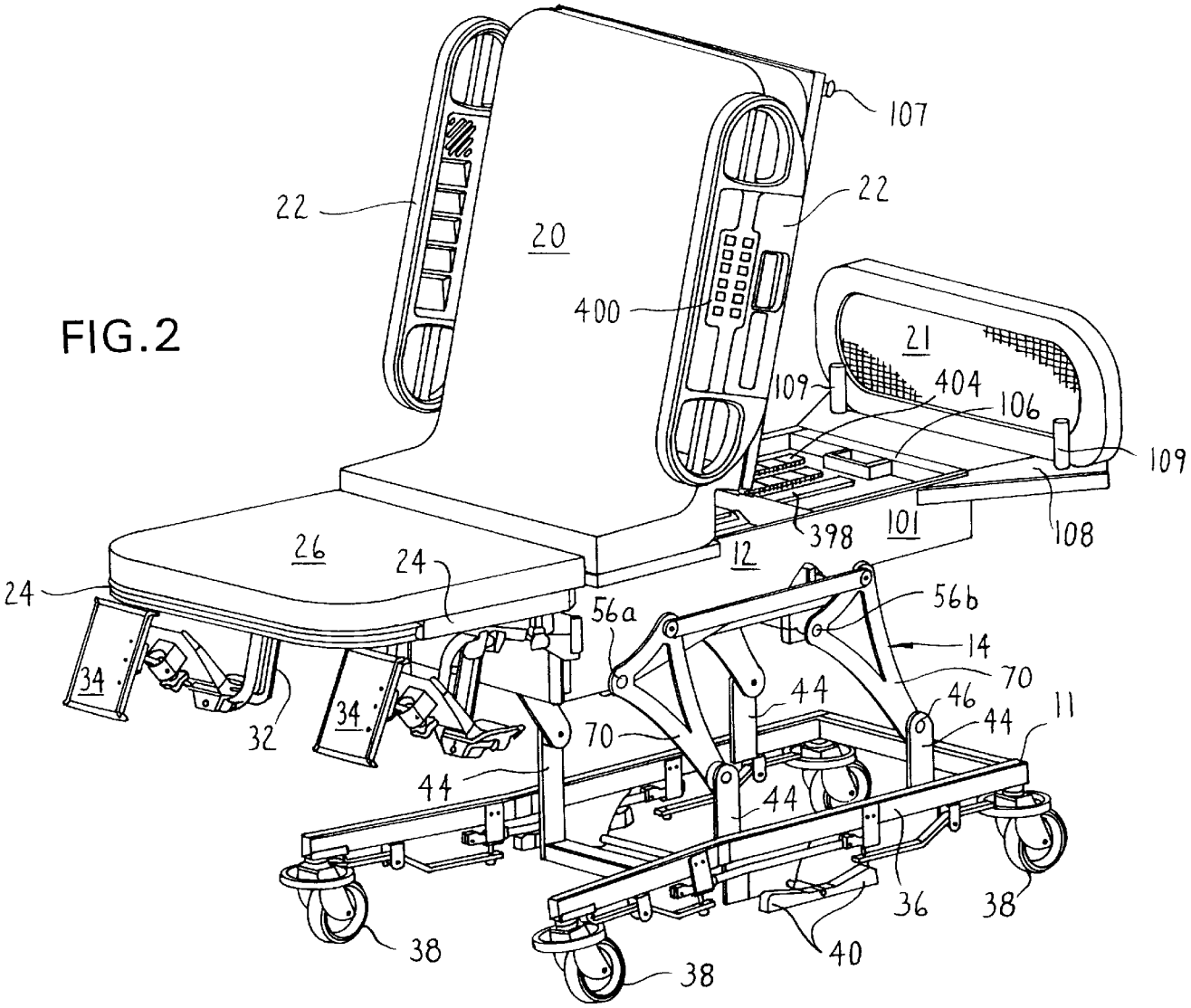
FIG. 2 is a perspective view illustrating the bed of FIG. 1 illustrating in detail some of the components of the bed.

Bed base 11, shown in detail in FIG. 2, includes a generally U-shaped horizontally oriented base frame 36. The elongated side sections of the frame 36 are normally covered by shells 37 (FIG. 1). Four casters 38 are attached to the four corners of the frame 36 so as to provide the bed 10 with mobility. A set of foot pedals 40 are secured to the base frame 36. Foot pedals 40 are connected to braking assembly, not illustrated, used to lock the casters 38 in place in order to regulate the mobility of the bed 10. Attached to the inner surfaces of the side elements of the base frame 36, are four support stanchions 44 arranged to define the corners of the rectangle. Each stanchion 44 includes an end section 46 distal from the base frame to which complementary components of the bed lift assembly 14 are attached.

Figures 3, 3A:
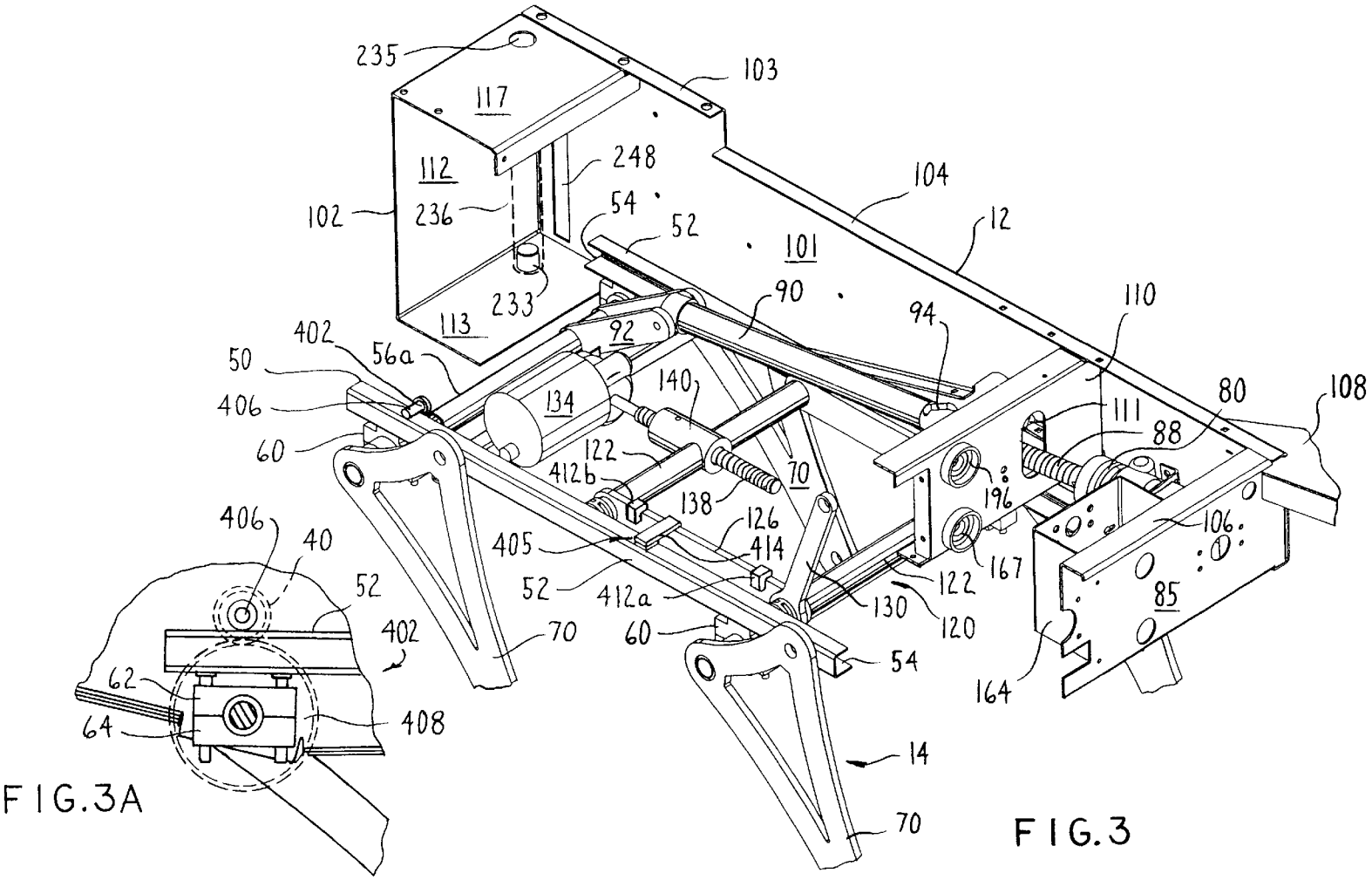
FIG. 3 is a perspective cut away view depicting the inner frame and litter frame of the bed of this invention.
FIG. 3A is a side view of a sensor assembly employed to monitor the height of the litter frame relative to the bed base.
Figure 4:
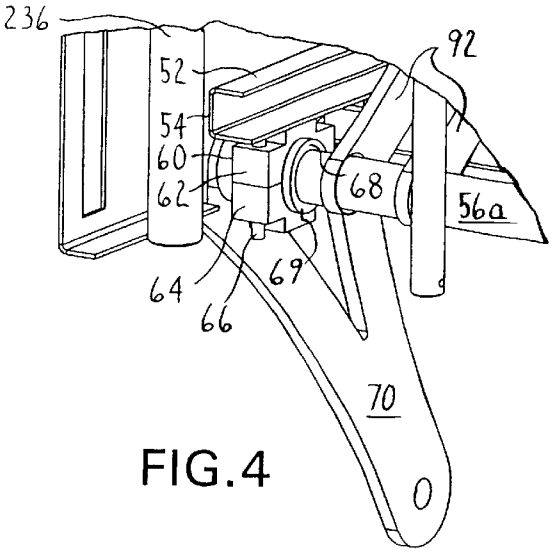
FIG. 4 is a perspective view detail view of a portion of the inner frame of FIG. 3.

Lift assembly 14 is connected to an inner frame 50 which, as is now described with respect to FIGS. 3 and 4, is the actual sub-assembly of the bed 10 to which the litter frame 12 is attached. Inner frame 50 includes a pair of parallel, spaced-apart rails 52. Each rail 52 has a generally U-shaped profile so as to define a channel 54. Rails 52 are secured together by a two parallel, spaced-apart, cylindrical cross beams 56*a* and 56*b* located adjacent the underside of the litter frame 12 that extend approximately across the litter frame. The rails 52 are secured to cross beams 56*a* and 56*b* so that the open faces of the channels 54 are directed toward each other.

Rails 52 are secured to the cross beams 56*a* and 56*b* by bushing assemblies 60 that allow the cross beams 54 to rotate relative to the rails. Each bushing assembly 60 has an upper bushing block 62 and a complementary upper lower bushing 64 that, collectively define a circular opening, not identified, through which an end of the cross beam 56*a* or 56*b* extends. Studs 66 that are integral with and that extend downwardly from the rails 56*a* and 56*b* secure bushings 62 and 64 together and to the rails with the aid of complementary fasteners, (not illustrated). Each bushing assembly 60 further includes a sleeve 68 fitted over the end section of the cross beam 56*a* or 56*b*. The sleeve 68 is seated in the opening defined by the bushing blocks 62 and 64. Each sleeve 68 is shaped so that the opposed ends thereof have outwardly extending circumferential flanges 69. Flanges 69 prevent the lateral shifting of rails 52 relative to the axes of cross bars 56*a* and 56*b*. Bushing blocks 62 and 64 and sleeves 68 are formed of low friction material, such as an acetal resin plastic manufactured under the trademark Delrin, in order to facilitate the rotation of the cross beams 56*a* and 56*b* in the bushing block assemblies 60.

Figure 5:
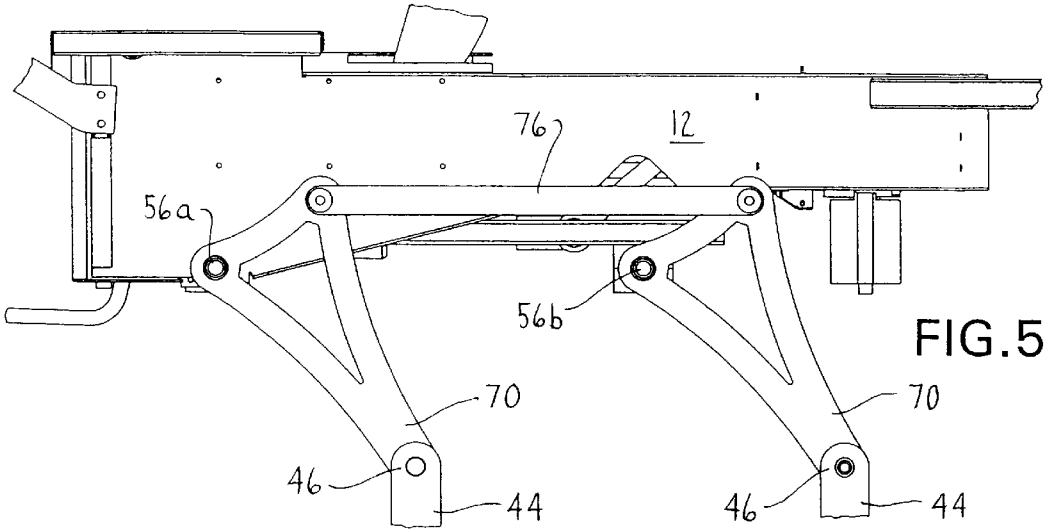
FIG. 5 is a side view of depicting the relationship of the litter frame to the lift assembly.

Lift assembly 14, now described with reference to FIGS. 3 and 5, includes four links 70 each of which has a triangular profile. Each lift link 70 is pivotally connected at one vertex to the end section 46 of an adjacent base support stanchion 44. The lift link vertex closest to the vertex connected to the stanchion 44 is connected to the end of one of the inner frame cross bars 56*a* or 56*b*. Collectively, the ends of each cross bar 56*a* and 56*b* are thus connected to the adjacent lift links 70 on either side of the litter frame 12. Cross bars 56*a* and 56*b* are connected to the associated lift links 70 so as to move in unison with the lift links. Lift assembly 14 further includes a pair of flat cross beams 76 which are located on the opposed sides of the litter frame 12. Each cross beam 76 is pivotally connected to the vertices of the adjacent lift links 70 that are distal from the vertices to which the links are attached to the stanchions 44. In preferred versions of the bed 10 of this invention, lift links 70 are shaped so that the distance between the vertices at which the links are connected to the base stanchions 44 are 14.5 inches from the vertices at which the links are connected to the cross bars 56*a* and 56*b*.

Figure 6:
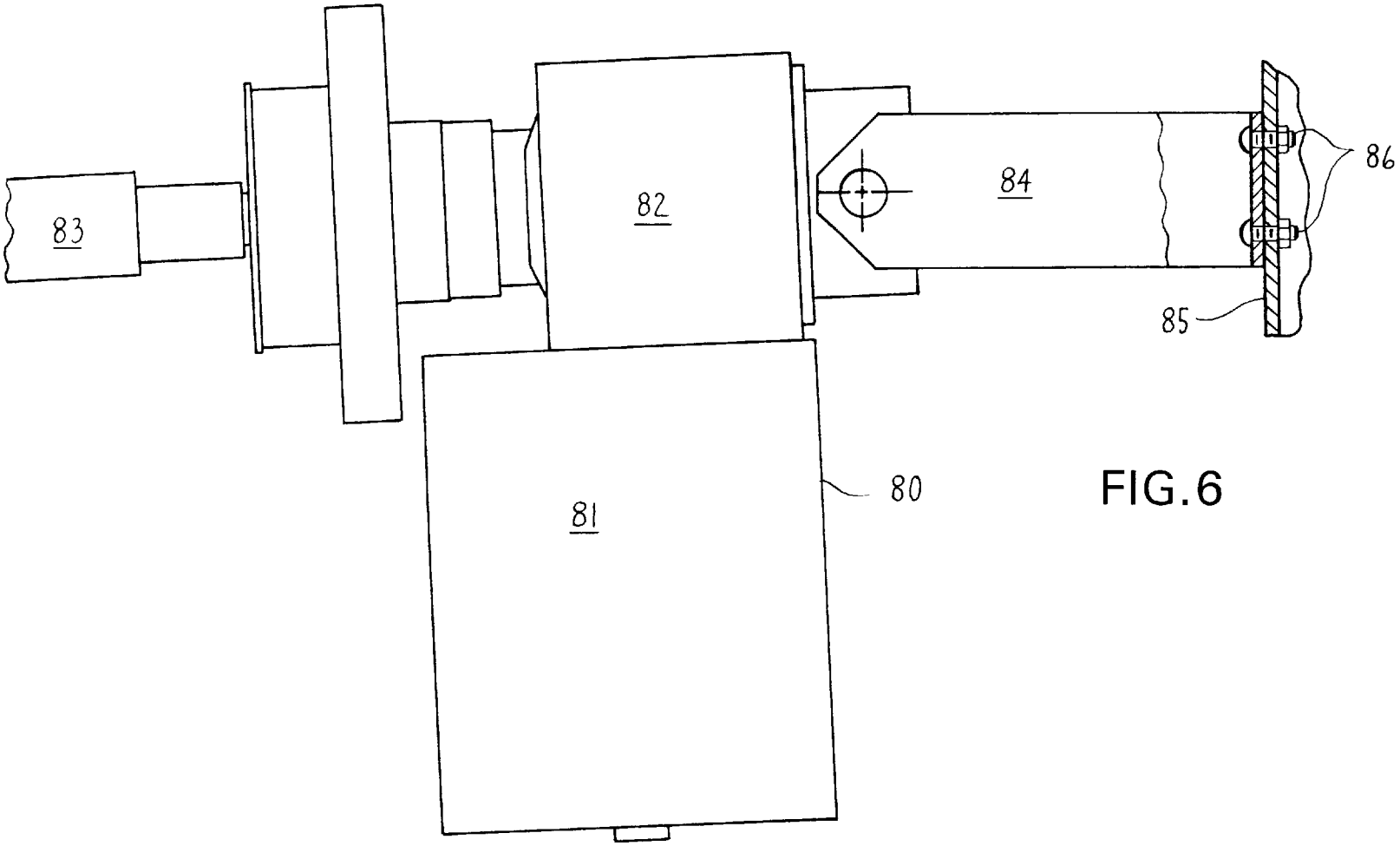
FIG. 6 is a side view illustrating how the lift assembly motor is connected to the litter frame.

Lift assembly 14 raises and lowers inner frame 50 and litter frame 12 with the power provided by an electric motor 80 housed in the litter frame as illustrated by FIGS. 3 and 6. Motor 80 is a right-angle motor having both a motor unit 81 and a gear box 82 that are assembled as a single unit. The shaft extending out of the motor unit 81 is vertically oriented, (shaft not illustrated). Gears in the gear box 82 transfer the power of the motor to a generally horizontally oriented output shaft 83, (gears not illustrated). A suitable right-angle motor 80 for use with this invention is marketed by the Emerson Electric Co. of St. Louis, Mo. as Motor No. K37XYA223733. Motor 80 is secured to a rectangular head plate 85 that forms the head of the litter frame 12. A trunnion 84 is fixedly secured to the inside surface of the head plate 85 by fasteners 86 so as to extend inwardly through the litter frame 12. Gear box 82 is pivotally mounted to the trunnion so that the motor 80 has a limited arc of rotation.

A ball screw shaft 88 is coupled to the motor output shaft 83 so as to rotate in unison with the output shaft 83. A drive tube 90 is coupled at one end of the free end of ball screw shaft 88 and extends toward the seat end of the litter frame 12. The end of the drive tube 90 distal from ball screw shaft 88 is attached to drive arms 92 that prevent the drive tube from rotating. A bearing nut 94 is secured over the end of the drive tube 90 fitted over the ball screw shaft 88 to couple the tube 90 to the screw shaft 88. Since drive tube 90 cannot rotate, the rotation of ball screw shaft 88 is translated through bearing nut 94 to force the drive tube to move along the ball screw shaft. The lift arms 92 to which the drive tube 90 is pivotally connected are parallel, spaced apart arms that extend upwardly from cross bar 56*a*. Lift arms 92 are arranged so that drive shaft 90 is connected to cross bar 56*a* at the same distance and angle relative to the axis of cross bar 56*a* that the cross beams 76 are connected to cross bar 56*a* through lift links 70.

Litter frame 12, as seen best by FIGS. 2 and 3, is formed out of two opposed side plates 101, the head plate 85 and seat plate 102 so as to have a generally rectangular shape. The portions of the side plates 101 forming the seat end of the litter frame 12 extend above the portions of side plates located below the Fowler section 16. A first pair of opposed, inwardly facing flanges 103 are formed around the upper edges of the side plates 101 adjacent to where the seat frame 18 is mounted. Flanges 103 serve as a support structures to which the seat frame 18 is mounted. The side plates 101 are provided with a second pair of opposed, inwardly directed flanges 104 that extend along the top edge of the side plates below the Fowler frame 16. Flanges 104 serve as the structural support for a cover 105 (FIG. 1) that covers the interior space of the litter frame 12 that is exposed with the raising of the Fowler frame 16. Cover 105 prevents inadvertent contact with the mechanical and electrical components of the bed 10 housed in the litter frame 12 that would otherwise be exposed upon the raising of the Fowler frame 16. The upper end of head plate 85 is shaped to form an outwardly extending horizonal flange 106. When the Fowler frame 16 is in the horizontal position, horizontal flange 106 serves as the physical support for rubber feet 107 attached to the head end corners of the Fowler frame.

Two wing plates 108 extend forward from the opposed head end corners of the litter frame 12. Collectively, wing plates 108 serve as the support structure to which the bed head board 21 is mounted. Each wing plate 108 is also provided with an open ended, upwardly extending base tube 109. Base tubes 109 function as sockets for receiving poles for intravenous assemblies and other medical assemblies that the woman resting on the bed may require.

A cross web 110, which extends between the side plates 101, provides the litter frame 12 with added structurally rigidity. The cross web 110 is located towards the head end of the litter frame 12. Cross web 110 is formed with a number of openings through which the drive shafts of this bed 10 extend. One opening is a vertically elongated opening 111 through which the lift assembly ball screw shaft 88 extends. Opening 111 is vertically elongated to allow for the up-and-down movement of shaft 88 as the lift assembly 14 is actuated.

Seat plate 102 is actually a three-sided generally U-shaped member. Plate 102 has a vertically oriented base or center section 112 which forms the rear, seat face, end of the litter frame 12. A bottom section 113, which extends perpendicularly from the end of the lower edge of the center section 112, is secured to the adjacent lower, longitudinally extending edges of the side plates 101. A top section 117 extends parallel to the bottom section 113 and is attached to the adjacent top-located flanges 103 associated with the side panels 101.

Figure 7:
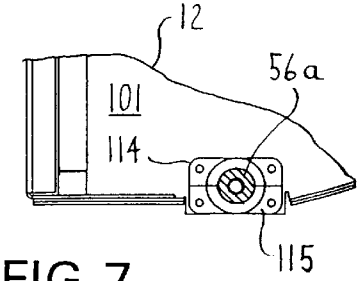
FIG. 7 is a side view illustrating how the litter frame is pivotally mounted to one of the inner frame cross beams.

The sections of the litter frame side panels 101 underneath the seat frame 18 extend downwardly over the ends of the underlying cross beam 56*a,* as depicted in FIG. 7. These sections of the side panels 101 are shaped to form concentric cut-outs 99 (FIG. 10), to facilitate pivotally seating this end of the litter frame 12 over cross beam 56*a*. An upper bushing 114 and a complementary lower bushing 115 are mounted in the side panel cut-outs. Bushings 114 and 115 collectively defining an opening through which the end of the cross bar 56*a* extends so as to couple the litter frame 12 to the cross bar. Bushings 114 and 115 are formed from Delrin plastic or other low friction material to facilitate the pivoting of the litter frame 12 around the cross bar 56*a*.

Figure 9:
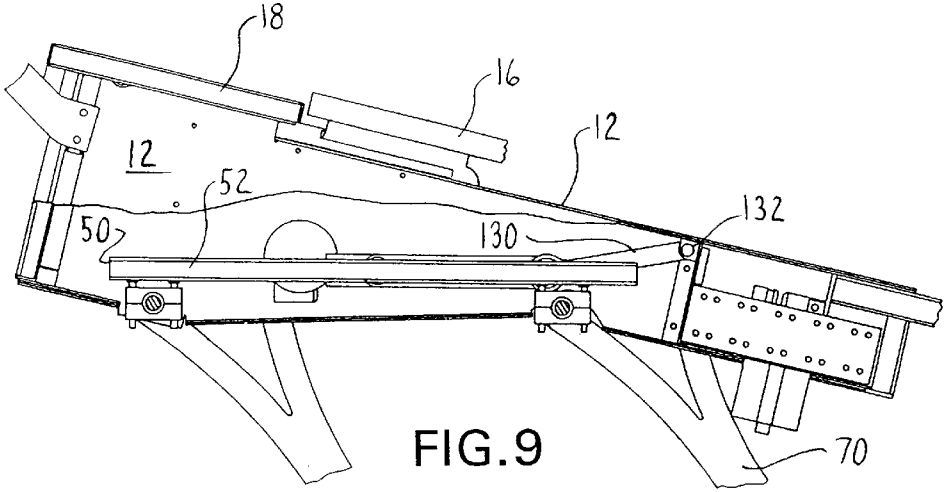
FIG. 9 depicts how the litter frame may be selectively pivoted into a, head-down, or Trendelenburg, position.
Figure 8:
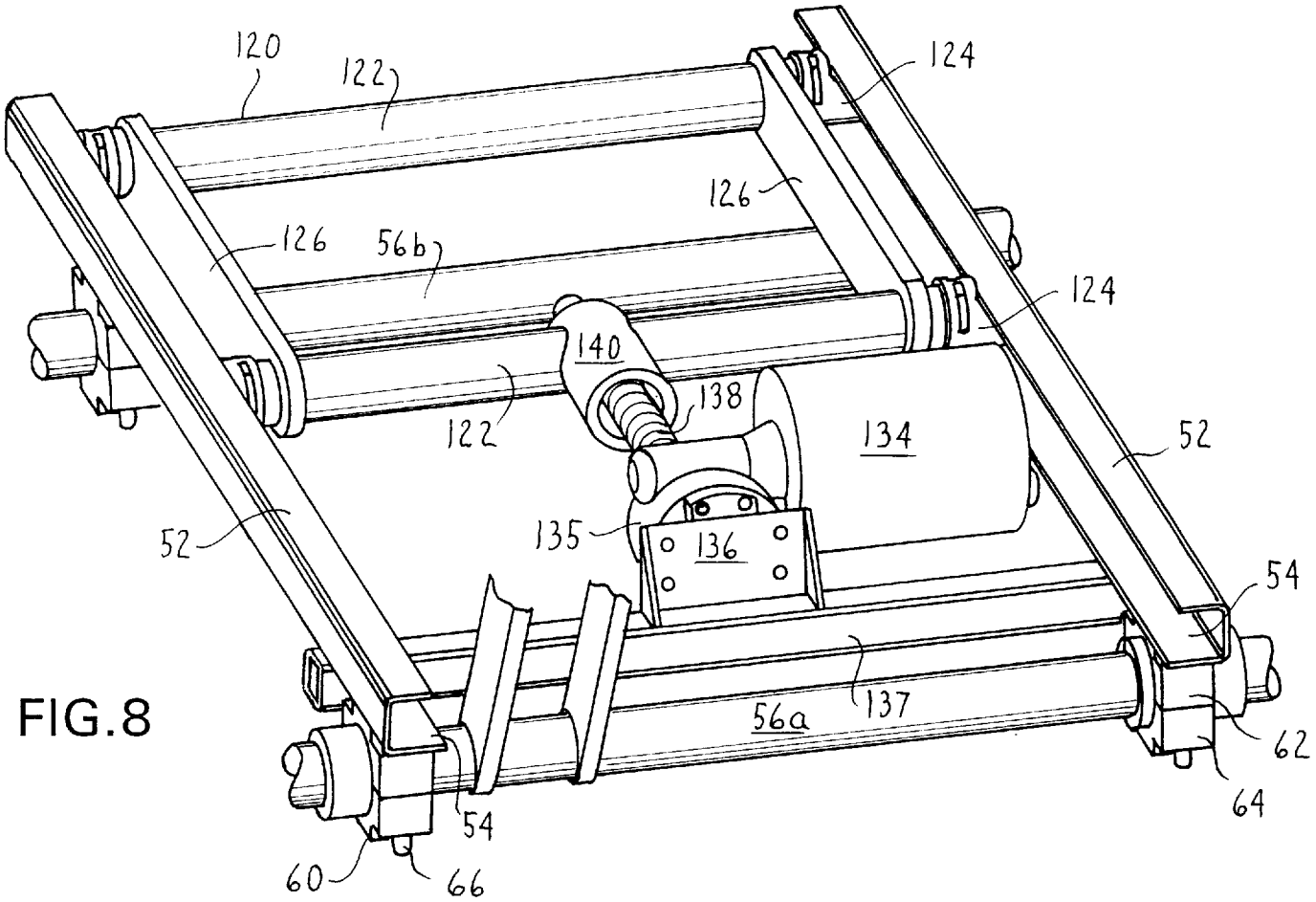
FIG. 8 is a perspective view of the carriage which travels along the inner frame so as to control the pivoting of the litter frame relative to the inner frame.

The opposed end of the litter frame 12 is secured to the inner frame 50 by a carriage 120 that travels along rails 52, now described by reference to FIGS. 3 and 8. Carriage 120 has a pair of parallel, spaced apart sleeves 122 which extend between the rails 52. Solid blocks 124 formed of non-metallic, low friction, material, for example, nylon, extend outwardly from the opposed ends of each sleeve 122 and into the channels 54 defined by the rails 52. Sleeves 122 are connected together to move in unison by two parallel link arms 126. Litter frame 12 is secured to carriage 120 by two crank arms 130. Each crank arm 130 is pivotally connected at one end to a separate end of the sleeve 122 located closest to the head end of the litter frame 12. The opposed end of each crank arm 130 is pivotally connected to a mounting block 132 that is secured to the litter frame cross web 110 (FIG. 9). Carriage 120 is moved along the rails 52 by a motor 134. Motor 134 is a right-angle motor similar in shape, size and power output to motor 80. The motor 134 is secured to the inner frame 50 by a bracket 136 connected to a gear box casing 135 integral with the motor. Bracket 136 is connected to a support beam 137 that is extends across inner frame 50 and is connected to opposed undersurfaces of rails 52 adjacent cross beam 56*a*. The motor output shaft, not illustrated, is connected to a acme screw shaft 138 that extends longitudinally towards the head end of the litter frame 12. The free end of acme screw shaft 138 is fitted into a bearing nut assembly 140 mounted integral to the carriage sleeve 122 closest the motor 134.

The rotation of acme screw shaft 138 by motor 134 is transferred through bearing nut assembly 140 into reciprocal motion that causes carriage 120 to move along the length of the inner frame 50. As seen in FIG. 9, when the motor 134 is actuated to cause the carriage 120 to move towards the motor 134, crank arms 130 are pivoted downwardly. The downward movement of crank arms 130 causes the adjacent end of litter frame 12 to undergo a like movement so that the litter frame pivots downwardly around cross beam shaft 56*a* into the Trendelenburg position. When carriage 120 is moved back towards the head end of the litter frame 12, crank arms 130 force the litter frame upwards so as to return it to its normal position parallel to the inner frame 50 and the underlying floor surface.

Figure 10:
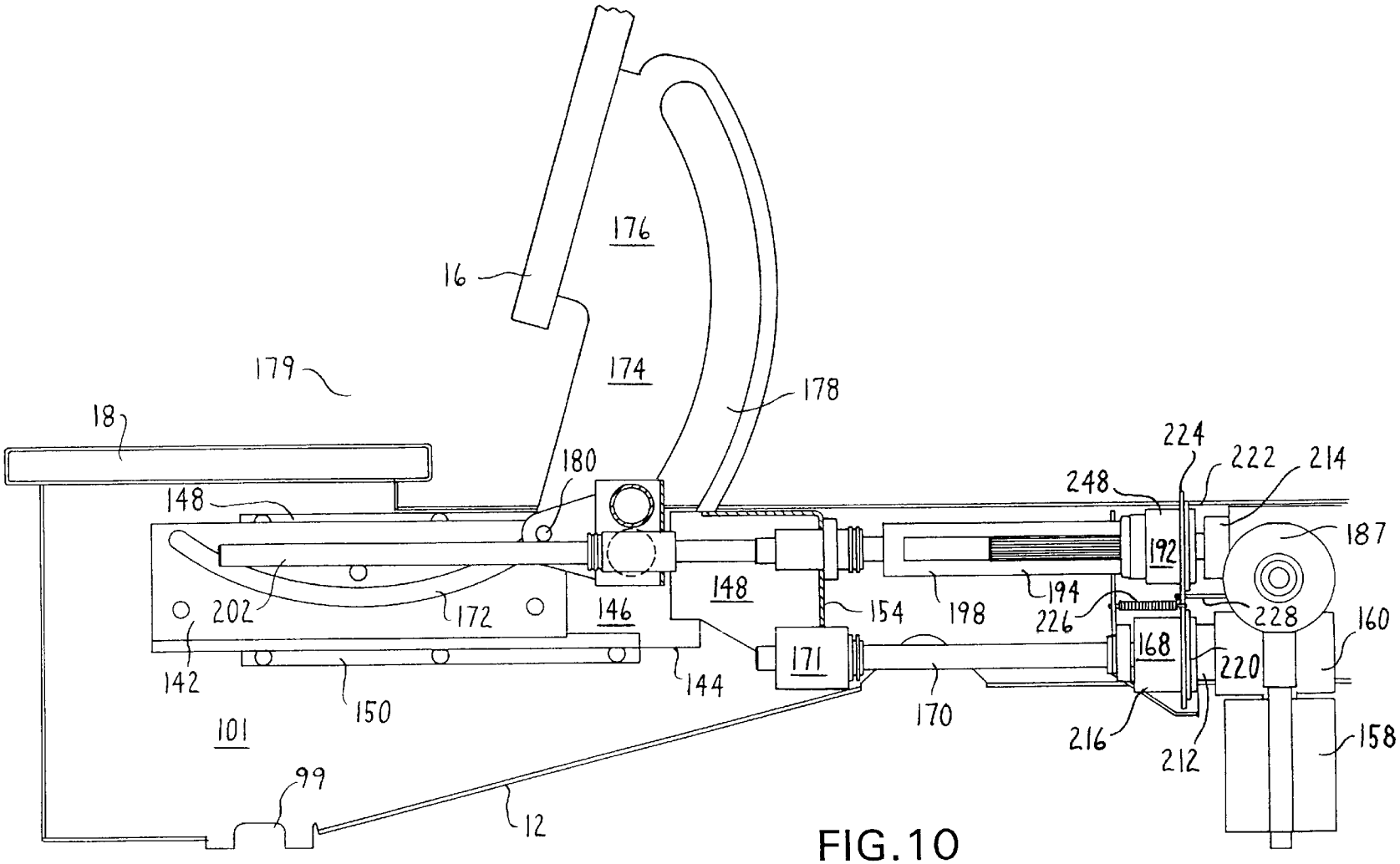
FIG. 10 is a side view depicted how the Fowler frame is attached to the litter frame.
Figure 11:
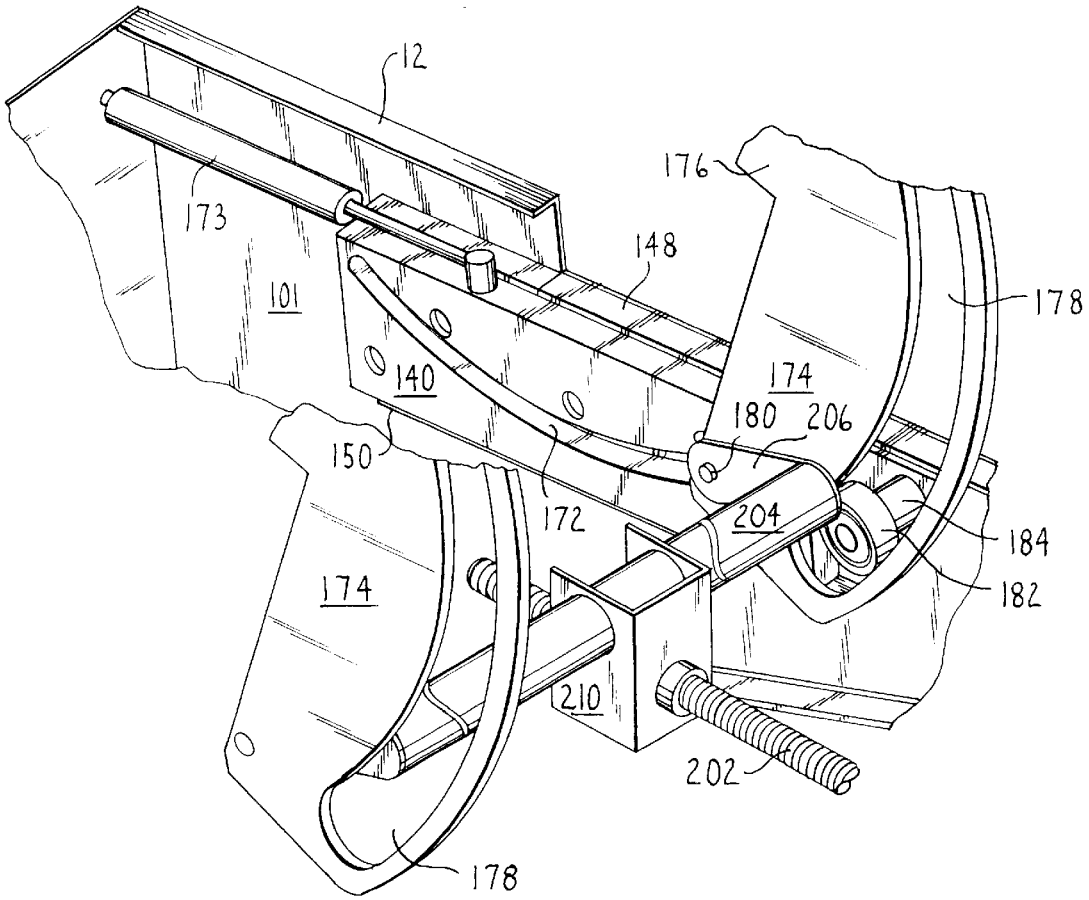
FIG. 11 is a perspective view illustrating how the Fowler frame is able to pivot relative to the Fowler carriage.

Turning to FIGS. 10 and 11, it can be seen that the Fowler frame 16 is pivotally connected to a pair of guide plates 142 which are part of a Fowler carriage 144 that is selectively positioned along the litter frame 12. Specifically, Fowler carriage 144 includes two metal, rectangular profile mounting plates 146 located against the opposed litter frame side plates 101. Each mounting plate 146 is slidably held against the inner surface of the adjacent side plate by opposed upper and lower guide rails 148 and 150, respectively. Guide rails 148 and 150 each have an L-shaped structure and are fixedly secured to the associated side plate 101 to allow the complementary mounting plate 146 to move longitudinally therebetween. Mounting plates 146 are connected together by a carriage plate 148 that extends across litter frame 12 in proximity to cross web 110. Carriage plate 148 is formed out of metal, is vertically aligned and is generally symmetrically shaped relative to the longitudinal axis of the litter frame 12. The carriage plate 148 is shaped to extend perpendicularly inwardly from the associated mounting plates 146. The carriage plate 148 is shaped to have a center section 154 that extends forward of the mounting plates towards the head end of the litter frame 12.

Fowler carriage 144 and the Fowler frame 16 supported thereon are moved along the length of the litter frame 12 by a motor 158. Motor 158, like motor 80, is a right-angle motor mounted directly to the litter frame 12. Specifically, motor 158 has a gear box casing 160 integral therewith to which a mounting bracket 162 is secured. The mounting bracket 162 is secured to a three-sided motor-mount bracket 164 (FIG. 3) secured to the inside surface of the litter frame head plate 85. The shaft out of the motor gear box is coupled to a clutch mechanism 168. The distal end of the clutch mechanism 168 is secured to a rotating ball screw shaft 170. As will be discussed further hereinafter, clutch mechanism 168 is configured so that ball screw shaft 170 normally rotates when motor 158 is actuated. Ball screw shaft 170 extends through an opening 167 (FIG. 3) located in the litter frame cross web 110. The free end of ball screw shaft 170 is coupled into a bearing nut assembly 171 mounted to the center section 154 of carriage plate 148. When the motor 158 is actuated to cause the ball screw shaft 170 to rotate in one direction, the Fowler carriage 144 and Fowler frame 16 are pulled in a first direction along the length of the litter frame 12. When the ball screw shaft 170 is rotated in the opposite direction, the Fowler carriage 144 and Fowler frame 16 are displaced along the litter frame 12 in a second direction opposite the first direction.

The guide plates 142 to which the Fowler frame 16 is attached are formed of Delrin or other low friction material. Each guide plate 142 abuts and is attached to an adjacent mounting plate 146 so as to move in unison with the mounting plate 146. Each guide plate 142 is formed with a downwardly directed arcuate slot 172. Slots 172 are centered about an axis that extends laterally across litter frame 12 and, as represented by point 179, is located above the litter frame. A spring-loaded biasing rod 173 is connected between the litter frame side plate 101 underneath the seat frame 18 to the top corner surface of the adjacent Fowler guide plate 142. For a purpose that will be explained hereinafter, biasing rods 173 are loaded to exert a force on the Fowler carriage 144 that forces the carriage toward the head end of the litter frame 12.

Cam followers 174 formed out of metal plates are attached to the opposed longitudinal sides of the Fowler frame 16. Each cam follower 174 is shaped to have a tab portion 176 that extends upwardly from the main body of the follower that defines the portion of the follower to which the Fowler frame 16 is actually attached. The opposed, bottom portion of the cam follower 174 is formed to have an arcuate shape. The cam follower 174 is further shaped to define an arcuate slot 178 that extends the length of the follower along the bottom portion thereof. Each cam follower 174 is positioned adjacent a separate one of the guide plates 142. Each cam follower 174 is coupled to the adjacent guide plate 142 by a guide pin 180 that projects into the adjacent guide plate slot 172. Guide pins 180, which are rotatingly connected to the cam followers 174, are located adjacent the ends of the cam followers closest to the seat end of the litter frame 12.

Each cam follower 174 abuts a cam bearing 182 which is secured to the adjacent Fowler carriage mounting plate 146. Each cam bearing 182 is rotatably secured to a mounting boss 184 integral with the mounting plate 146 that is forward of the location the guide plate 142 is secured to the mounting plate 146. The individual cam bearings 182 are fitted in the slots 178 formed in the cam followers 174. As the cam followers 174 are displaced relative to the guide plates 146, the force of bearings acting against the followers, urges the followers, and attached the Fowler frame 16, upwards. More specifically, the Fowler frame 16 rotates through an arc centered around the axis 179 around which the guide plate arcuate slots 172 are centered. Consequently, when the Fowler frame 16 is upwardly displaced, the frame 16 undergoes a rotational movement so as to be displaced both upwardly relative to the litter frame 12 and rearwardly towards the seat frame 18.

Figure 12:
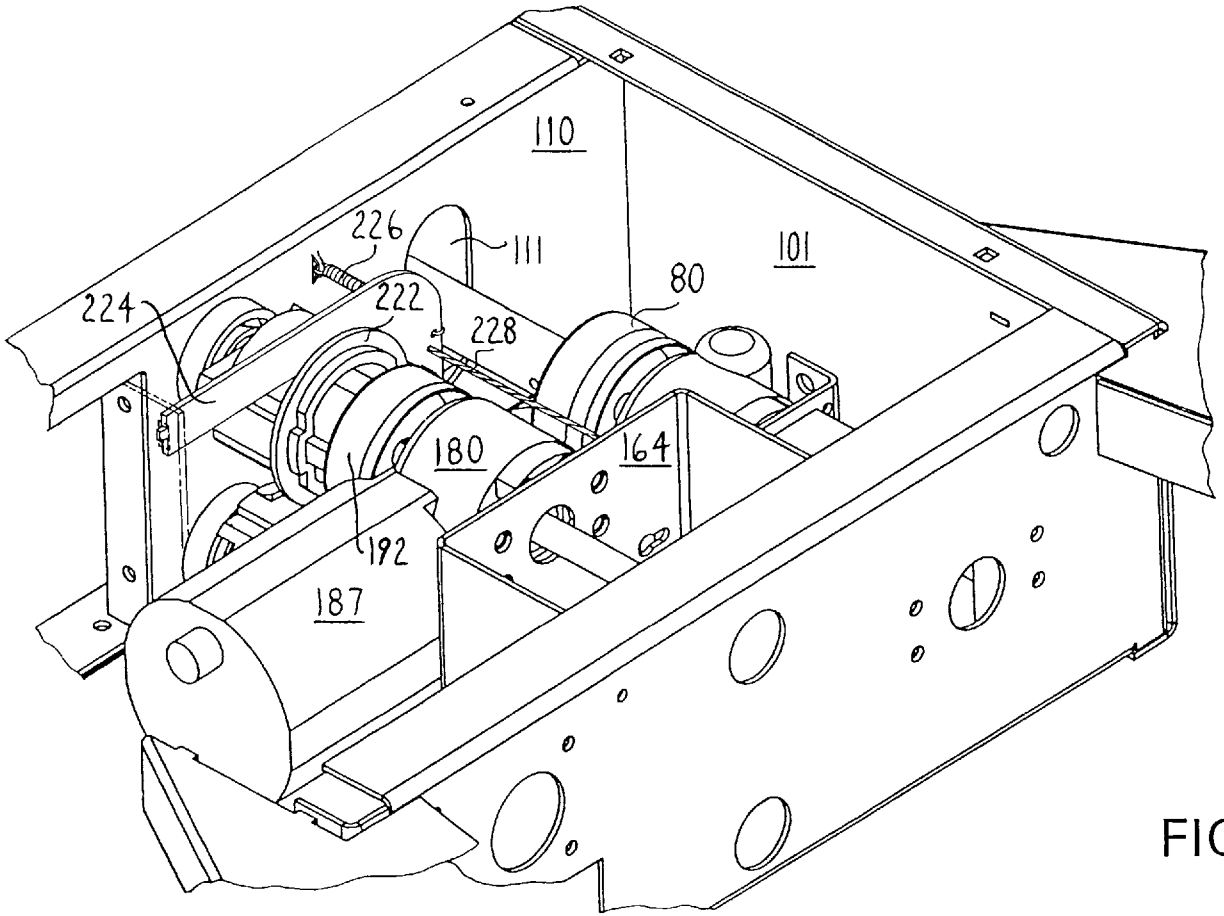
FIG. 12 is a top view illustrating how the clutch disengagement plate associated with Fowler frame operates.

The motive force to rotate the Fowler frame 16 is supplied by a right-angle motor 187 mounted to the litter frame 12. Motor 187 is secured to the litter frame 12 so as to be located directly above motor 158. A bracket, (not illustrated,) that extends between a gear box casing 188 (FIG. 12) integral with motor 187 and the motor-mount bracket 164 secures the motor 187 in position. The motor output shaft from gear box 187 is coupled to a clutch mechanism 192 similar to clutch mechanism 168. The distal end of clutch mechanism 168 is connected to a rotating spline shaft 194. Spline shaft 194 extends through an opening 196, (FIG. 3), formed in the top of the litter frame cross web 110. An elongated spline sleeve 198 is coupled to the carriage plate center plate 154 and is positioned to extend over the spline shaft 194. The inner bore of spline sleeve 198 is provided with inwardly directed teeth designed to engage the spline shaft 194, (sleeve bore and teeth not identified). The engagement of the spline sleeve 198 with the shaft allows the sleeve 198 to both rotate in unison with the shaft 194 and move axially along the length of the shaft 194.

A ball screw shaft 202 is connected to the free end of spline sleeve 198 to rotate in unison with the sleeve 198. Ball screw shaft 202 is coupled to a cross tube 204 that pivots the Fowler cam followers 174. Cross tube 204 is a cylindrical tube that extends between the cam followers 174. The ends of cross tube 204 are rigidly connected to aligned pivot links 206. Each pivot link 206 is pivotally connected by an appropriate fastener, (not illustrated) to an exposed end of the adjacent follower guide pin 180. A bearing nut assembly 210 is mounted to the center of the cross tube 204 to receive the ball screw shaft 202. In the depicted version of the invention, bearing nut assembly 210 is mounted to cross tube 204 below the axis of the tube 204.

Clutch assemblies 168 and 192 to which the Fowler carriage screw shaft and the Fowler frame pivot screw shaft 170 and 202, respectively, are coupled are aligned with each other. Each clutch assembly 168 and 192 has an inner member 212 and 214, respectively, coupled to the output shaft from the associated motor, 158 and 187, respectively. Complementary outer members 216 and 218 are coupled over the inner members 212 and 214, respectively, to transfer the rotational power from the output shafts to the associated ball screw shafts 170 and 202, respectively. Integral with the outer casing of each clutch outer member 216 and 218 are flat circumferential disengagement rings 220 and 222, respectively. Disengagement rings 220 and 222 are located adjacent the exposed portions of the associated clutch inner members 212 and 214, respectively.

Each clutch assembly 168 and 192 normally transfers the power from the motor 158 and 187, respectively, with which the assembly is associated to the down-line ball screw shaft 170 and 202, respectively. Ball screw shafts 170 and 202 are, however, disengaged from the associated motors 158 and 187, respectively, by the actuation of a clutch disengagement plate 224, now described with respect to FIG. 12. Clutch disengagement plate 224 is a vertically aligned plate that is pivotally connected to bracket 225, (shown in phantom) integral with the litter frame 12. Clutch disengagement plate 224 is formed with a pair of cut-outs, (not identified) to facilitate the seating of the plate over the clutch assembly outer members 216 and 218. A spring 226 connected between the cross web 110 and the disengagement plate 224 normally holds the plate away from the clutch assembly disengagement rings 220 and 222.

A clutch cable 228 that extends from the head end of the litter frame 12 is connected at one end to the disengagement plate 224. The opposed end of the clutch cable is connected to a handle, (not illustrated,) mounted to the litter frame 12. When the handle is depressed, a tension is placed on the clutch cable 228 to pull the cable forward, against the clutch assembly disengagement rings 220 and 222. The disengagement rings 220 and 222 and associated outer clutch members 216 and 218, respectively, are then displaced along their center axes towards the head end of the litter frame 12. This movement of the outer clutch members 216 and 28 causes them to disengage from the complementary inner clutch members 212 and 214. As a result of this disengagement, ball screw shafts 170 and 202 are separated from the motors 158 and 187, respectively, to which they are normally coupled. This allows the ball screw shafts 170 and 202 to freely rotate relative to the motors 158 and 187, respectively.

Figure 13:
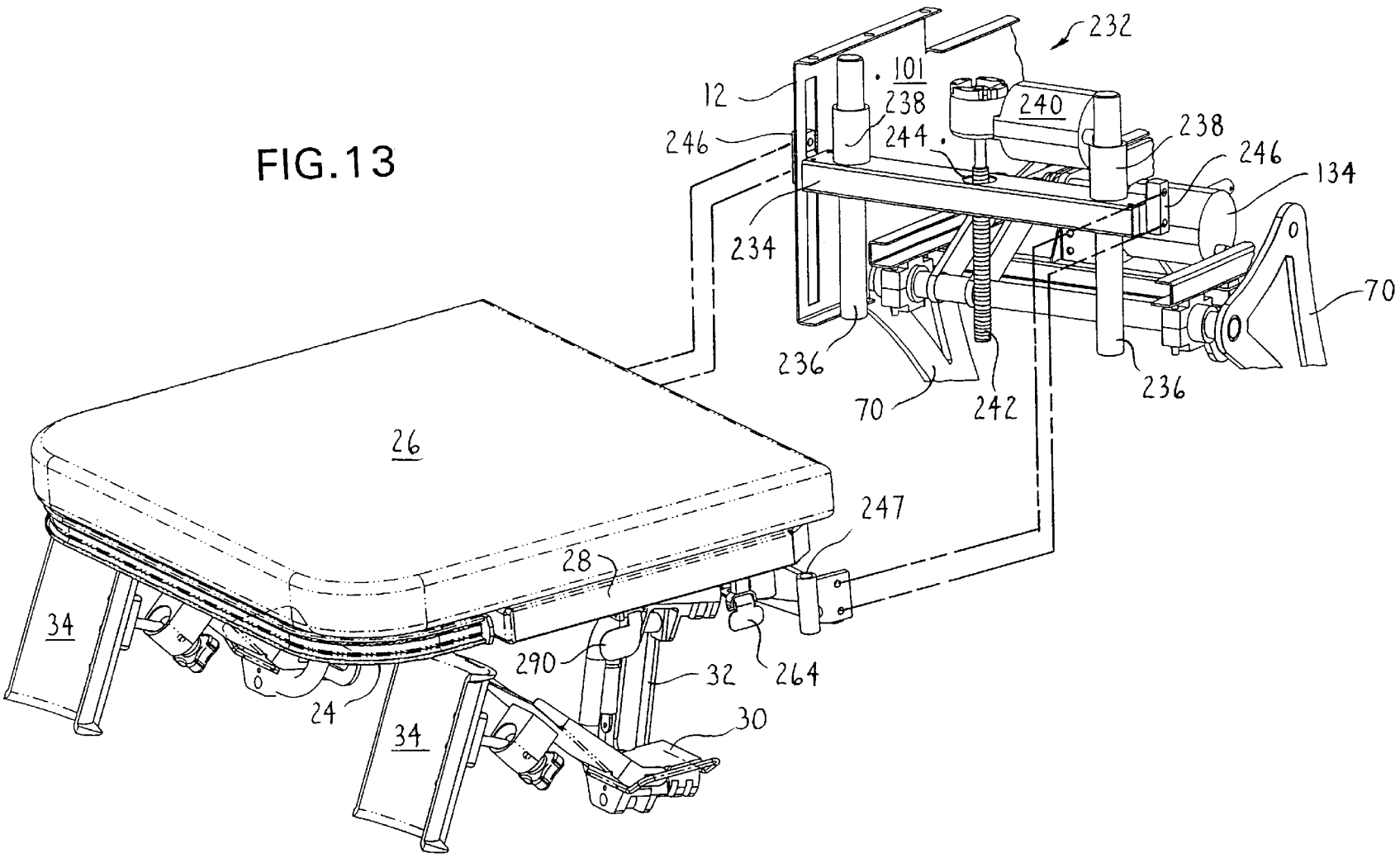
FIG. 13 is a partially exploded perspective view illustrating how the foot frame, the foot pans and the components associated therewith are connected to the litter frame by a foot frame lift assembly.

As depicted by FIG. 13, foot frame 24, foot pans 28 and the components of the bed 10 of this invention associated therewith are attached to litter frame 12 by a foot frame lift assembly 232. Lift assembly 232, includes a horizontally aligned lift bar 234 which is housed inside the litter frame 12. Lift bar 234 extends across the interior width of the litter frame 12 and is located adjacent the seat end of the frame. The lift bar 234 is fitted over a pair of vertically oriented cylindrical guide tubes 236. Guide tubes 236 are seated over bosses 233 that extends upwardly from opposed ends of the seat plate bottom section 113, (one boss 233 shown in FIG. 3). The top end of each guide tube 236 is fitted in a complementary opening 235 formed in the seat plate top section 117, (one opening 235 depicted in FIG. 3).

Lift bar 234 is formed with complementary bores, (not illustrated), through which the guide tubes 236 extend. In some versions of the invention, the lift bar bores through which guide tubes 236 extend are dimensioned to have a diameter greater than that of the guide tubes. In these versions of the invention, open ended sleeves 238 are secured to the lift bar 234 over the bores formed in the lift bar. Each sleeve 238 is provided with a tubular low friction bushing, (not illustrated), dimensioned to form a close fit between the sleeve and the guide tube 236 that extends therethrough. The sleeves 238 thus prevent any sway as the lift bar moves along the length of the guide tubes 236.

A motor 240 provides the power required to raise and lower the lift bar 234 as well as the foot frame 24, foot pans 28 and associated components attached thereto. Motor 240 is a right angle motor that is secured to the litter frame seat plate top section 117 by a bracket, (not illustrated). The output shaft, (not illustrated) associated with motor 240 is downwardly directed and oriented along the lateral center axis of lift bar 234. An acme screw shaft 242 is coupled to the output shaft of motor 240 so as to rotate in unison with the motor shaft. Acme screw shaft 242 extends downwardly through a center bore 244 formed along the lateral center axis of lift bar 234. The acme screw shaft 242 is coupled to a bearing nut assembly, (not illustrated), seated in the lift bar center bore 244. Consequently, depending on what direction motor 240 rotates acme screw shaft 242, lift bar 240 and the elements of this bed attached thereto will selectively move up or down.

Rectangular-profiled mounting brackets 246 are attached to the opposed ends of the lift bar 234. Each mounting bracket 246 extends through an elongated, vertically oriented slot 248 formed in the adjacent litter frame side plate 101 so as be substantially located outside of the litter frame 12. Attached to each mounting bracket 246 is a diagonally extending upright 250 that extends rearward of the litter frame 12.

Figure 14:
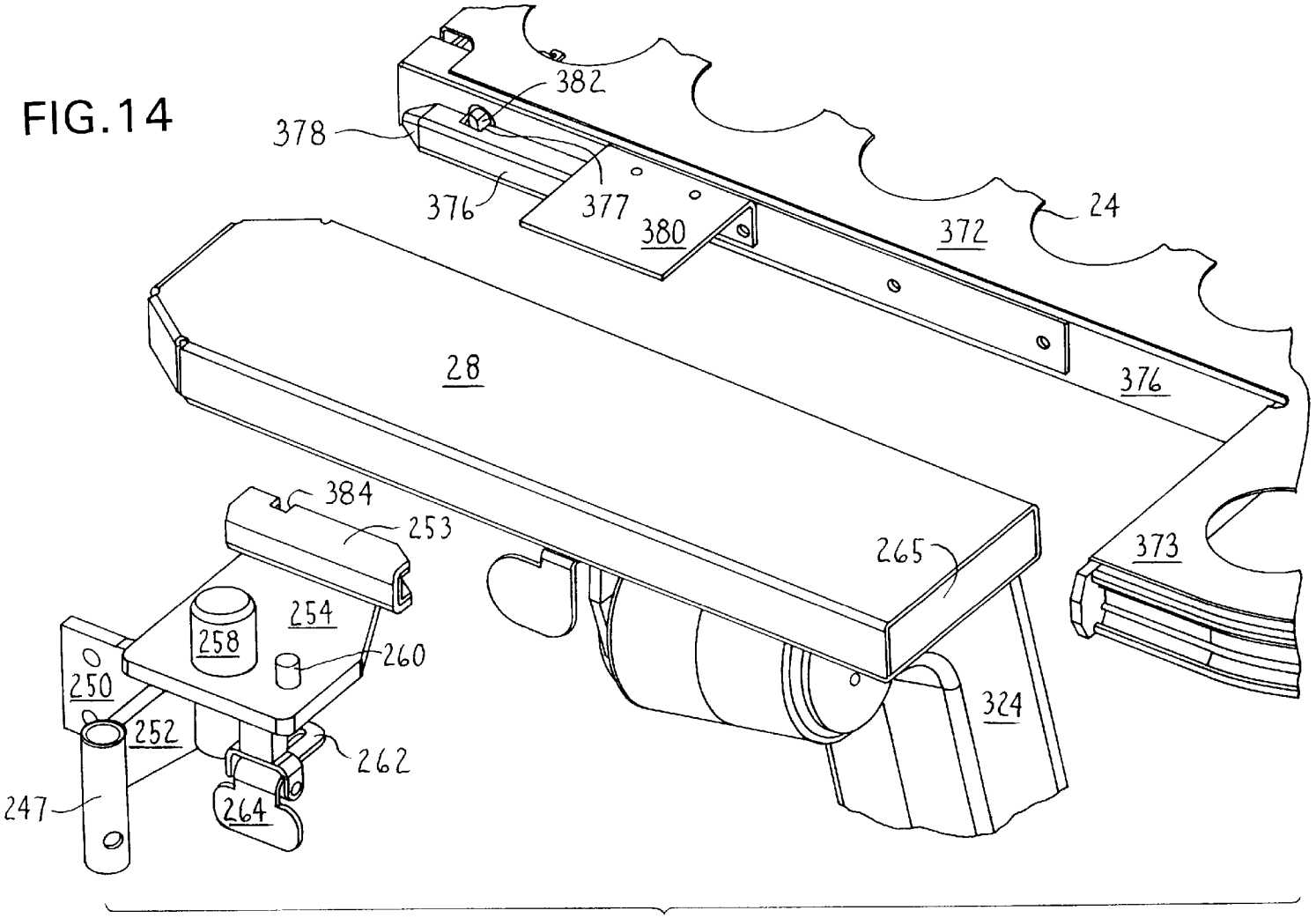
FIG. 14 is an exploded view illustrating how the foot frame and a foot pan are connected to the foot frame lift assembly.

As seen in FIG. 14, attached to the free end of each upright 250 is a horizontally oriented fixture plate 254 is welded or otherwise secured to the top edge of the upright. A flat cross web 252 extends laterally away from the upright 250 so as to extend out from underneath the fixture plate 254. A vertically oriented guide tube 247 is secured to the free end of the cross web 252. Guide tube 247 is provided for securing a complementary leg rest, (not illustrated and not part of this invention,) to the upright 250.

A solid, cylindrical mounting boss 258 is mounted to each fixture plate 254 to extend vertically through the plate. A small guide pin 260 is fitted to the fixture plate 254 so as to be spaced immediately rearward of the mounting boss. Guide pin 260 is coupled to a biasing assembly 262 attached to the bottom of the fixture plate 254 that normally holds the guide pin above the surface of the fixture plate. Biasing assembly 262 is controlled by a lever 264 that, when depressed, uncouples guide pin 260 from biasing assembly 262 so as to cause the guide pin to retract below the surface of fixture plate 254. As discussed below, mounting boss 258 and guide pin 260 cooperate to, respectively, couple the complementary foot pan 26 to the upright 250 and to hold the foot pan in the correct position. U-shaped rails 253 are secured to the opposed inside edges of the fixture plates 253. The rails 253 are secured to the fixture plates so that the open faces thereof are directed towards each other. As will be discussed hereinafter, rails 253 are dimensioned to receive complementary guide fingers associated with the foot frame 24.

Figure 15:
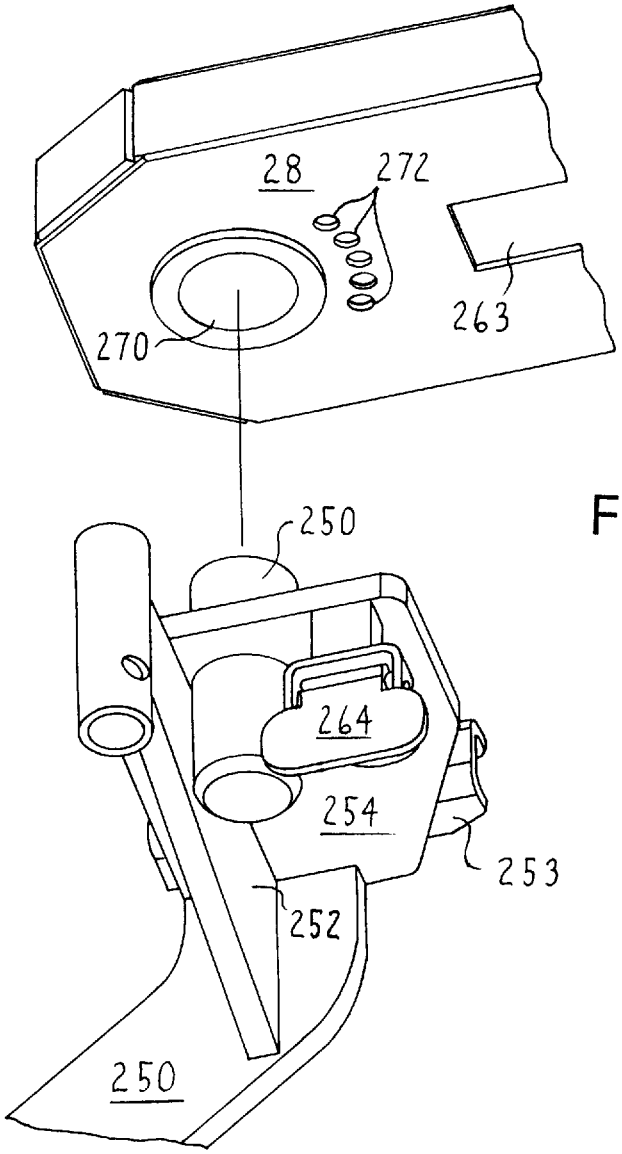
FIG. 15 is an exploded, upwardly oriented view illustration a portion of the bottom of a foot pan and how the foot pan is coupled to a complementary fixture plate.

Each foot pan 28, as seen in FIGS. 14 and 15, is formed out of a sheet of metal that is selectively shaped and bent to form an elongated structure that has a rectangular cross-sectional profile. The material forming the foot pan 28 is shaped so that the top surface, the side surfaces and the ends surfaces of the pan adjacent the litter frame 12 are continuous, planar surfaces. The end of the foot pan 28 distal from the litter frame 12 is closed by a plate 265. The bottom of each foot pan 28 is shaped to define a rectangular slot 263 that extends from the distal end of the pan forwards, along approximately three-fourths the length of the pan. A large mounting bore 270 is formed in the undersurface of foot pan 28 adjacent the end of the foot pan closest to the litter frame 12. Bore 270 is formed with a sufficient diameter to facilitate the coupling of the pan over the adjacent arm mounting boss 258. Bore 270 is further formed to allow foot pan 28 to rotate around the mounting boss 258. A set of smaller locking bores 272 are also formed in the undersurface of the foot pan 28. Locking bores 272 are centered along an arc concentric with the axis of mounting boss 258 and so each is positioned to selectively receive guide pin 260. Retractable guide pin 260 seats in one of the complementary bores 272 to lock the foot pans 28, and associated foot and leg rests 30 and 34, respectively, at an angle that best suits the needs of a particular woman.

Each foot rest 30 is pivotally connected to a brace block 273 as will be discussed hereinafter. The brace blocks 273 are connected to the linkage assemblies 32. Each linkage assembly 32 is secured to a foot pan carriage 274 that is positionable along the length of the associated foot pan 28 and now described by reference to FIGS. 16, 17 and 18. Each foot pan carriage 274 is formed out of a solid body 276 located immediately below the complementary foot pan 28. Formed integrally with and extending upwardly from the body 276 is a horizontally elongated mounting block 278 which is located in the slot 263 defined along the undersurface of the foot pan 28. Four casters 280 are rotatably secured to the mounting block 278 so that there are two casters on each side of the mounting block. The casters 280, which rest on the inside surface of the foot pan 28 adjacent the slot 263 are the members that actually suspend the foot rests 30 and associated components to the foot pan.

An elongated lock bar 282 is attached to inside surface of the upper plate of the foot pan 28. Lock bar 282 is secured to foot pan 28 so as to extend along the longitudinal axis of the pan and is positioned to be spaced above the carriage mounting block 278. Lock bar 282 is formed to define a number of spaced apart cutouts 284. Carriage body 266 is formed with an opening 286 in which a lock pin 288 is seated. A biasing mechanism, (not illustrated,) normally urges lock pin 288 upwards so that it seats in one of the lock bar cutouts 284. A release mechanism, having a lever 290, is attached to the lock pin 288 so as to cause the pin to retract. When lever 290 is depressed to cause lock pin 288 to retract, carriage 274 can be positioned along the length of the foot pan 28 to facilitate proper placement of the foot and leg rests 30 and 34, respectively. Once foot and leg rests 30 and 34, respectively, are properly positioned, pressure on lever 290 is released. Assuming the lock pin 288 is positioned underneath one of the cutouts 284, the pin will then seat in the cut-out to lock the foot and leg rests 30 and 34, respectively, in place.

Each brace block 273 is generally a solid block of metal. The linkage assembly 32 which connects the brace block 273 to the foot pan carriage 274 consists of two guide links 292 and 294 and a support link 296. Guide links 292 and 294 are formed out of flat, identically shaped, pieces of metal. Support link 296 is formed out of a tubular member that has sufficient strength to support the foot rest 30-leg rest 34 sub-assembly when it is in the elevated state. Both the guide links 292 and 294 and the support link 296 are formed to have approximately an elongated C-shaped such that the center section of each link has a relatively long linear profile.

Guide links 292 and 294 and support link 296 are pivotally connected at the opposed ends thereof to the foot pan carriage 274 and the brace block 273. One end of guide link 292 is housed in a first slot 298 formed in the foot pan carriage 274. The opposed end of guide link 292 is seated in a first slot 299 formed in the base of the brace block 273. Guide link 294 is connected is housed in a second slot 302 formed in the foot pan carriage 274 that is located adjacent to slot 298. The opposed end of guide link 294 is seated in a second slot 302 formed in the brace block 273. Support link 296 is seated at one end in a slot 304 formed in the foot pan carriage 274; the opposed end of link 296 is seated in a complementary slot 306 formed in the brace block 273.

Figure 19:
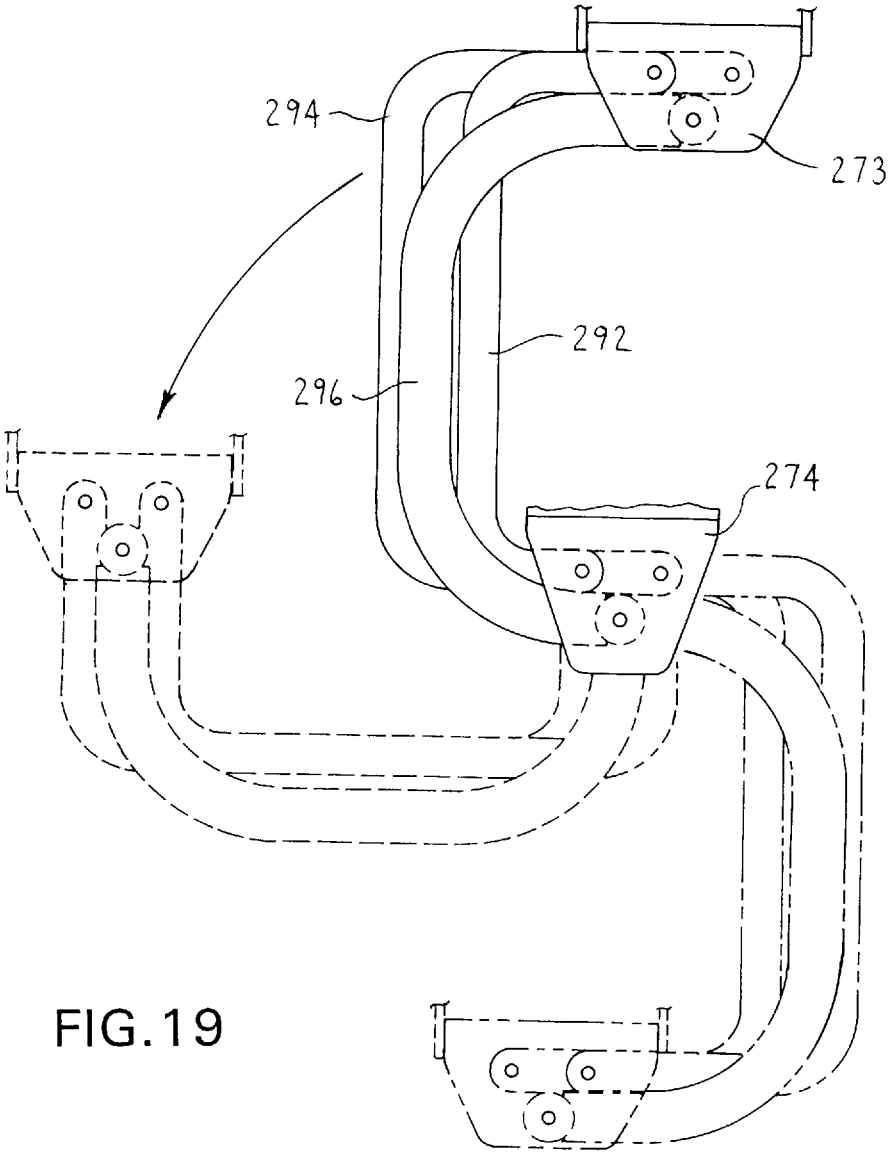
FIG. 19 is a diagrammatic illustration of how the links forming the foot rest linkage assembly are arranged and how the linkage assembly is pivoted to move the foot rest between the in-use and stowed positions.
Figures 20A, 20B, 20C:
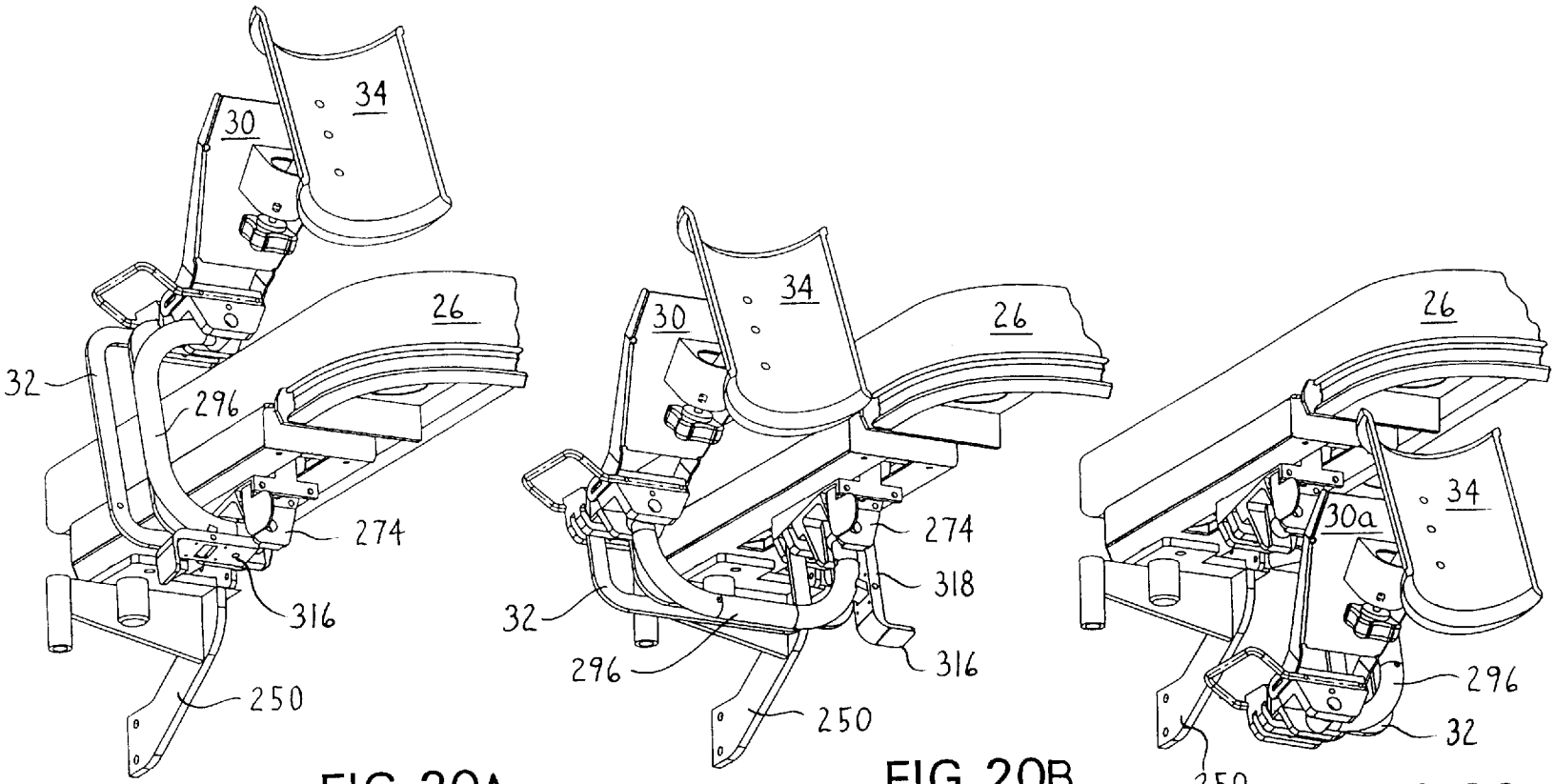
FIGS. 20A, 20B, and 20C illustrate how the foot rest-leg rest-sub assembly of this invention is stowed below the foot pan with which the assembly is associated.

As best seen by reference to FIG. 19, guide links 292 and 294 are pivotally connected to the complementary foot pan carriage 274 and brace block 273 along parallel axes that are vertically aligned and horizontally spaced apart from each other. Support link 296 is connected to the foot pan carriage 274 and brace block 273 along axes that, in terms of a base 11-reference coordinate system, are below and between the axes-of-connection of the guide links 292 and 294. As depicted by FIGS. 20A, 20B, and 20C, an advantage of this arrangement is that in ensures that as the brace block 273 is rotated between the stowed position underneath the foot pan 28 to the in-use position above the lower mattress 26, the brace block and the components attached to it will maintain a constant, upwardly directed orientation.

Linkage assembly 32 is locked in the upright, extended position by a lever 316. Lever 316 is an L-shaped member that is pivotally attached to the support link 296 adjacent foot pan carriage 274. The lever 316 has a relatively long base section 318 that extends approximately parallel with the curved section of the support link 296 to which the lever is attached. Lever base section 318 is dimensioned so that when linkage assembly 32 is in the upright position, the free end of base section 318 abuts the adjacent surfaced of the foot pan carriage 274 that define the slot 306 in which support link 296 is seated. When medical personnel wish to lower the foot rest 30, lever 316 is depressed to pivot the lever base away from the foot pan carriage 274. The foot rest 30 can then be pivoted to its stowed position underneath the foot pan 28.

Figures 17, 18:
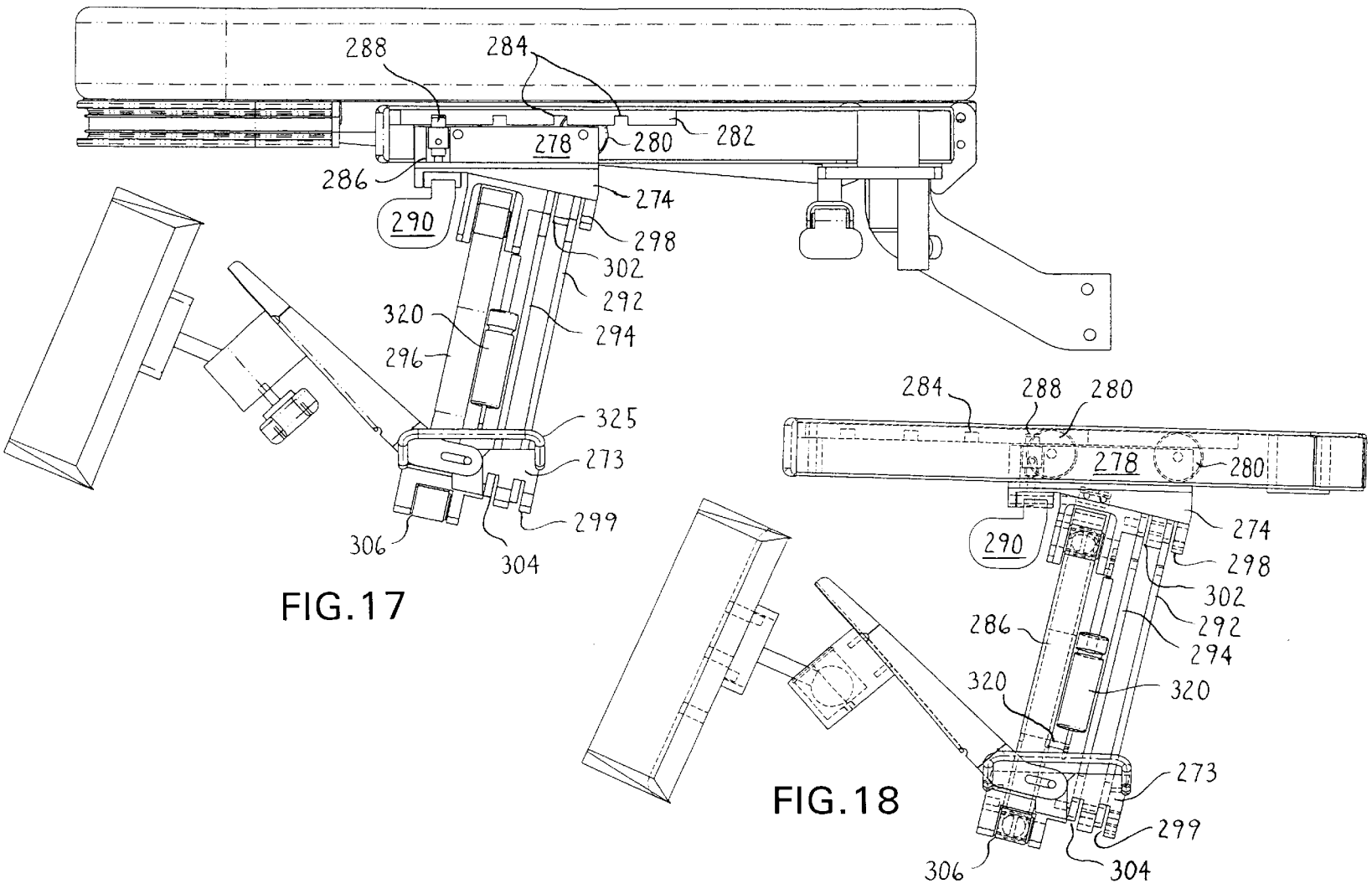
FIG. 17 is a side cutaway view illustrating a foot pan carriage is seated in a complementary foot pan.
FIG. 18 is a phantom view of the assembly depicted in FIG. 17 illustrating how the foot pan carriage can be moved along the length of the foot pan.

Linkage assembly 32 is also provided with a pneumatic shock absorber 320, best seen by FIGS. 17 and 18. One end of shock absorber 320 is pivotally connected to carriage tab 302. The opposed end of shock absorber 320 is pivotally connected to a small post 322 (FIG. 22) that extends outwardly from the side of support link 296. Shock absorber 320 serves as a motion damper that prevents the foot rest 30 from simply swinging freely downwards when the linkage assembly 32 is unlocked from the upright position. Linkage assembly 32 is further provided with a casing 324 (FIG. 1) that encloses the brace block 273, the foot pan carriage 274, the links 292–296, and the shock absorber 320. A generally U-shaped handle 325 extends outwardly from the forward and rear sides of the brace block 273 to allow medical personal to raise or lower the foot rest 30.

Figure 21:
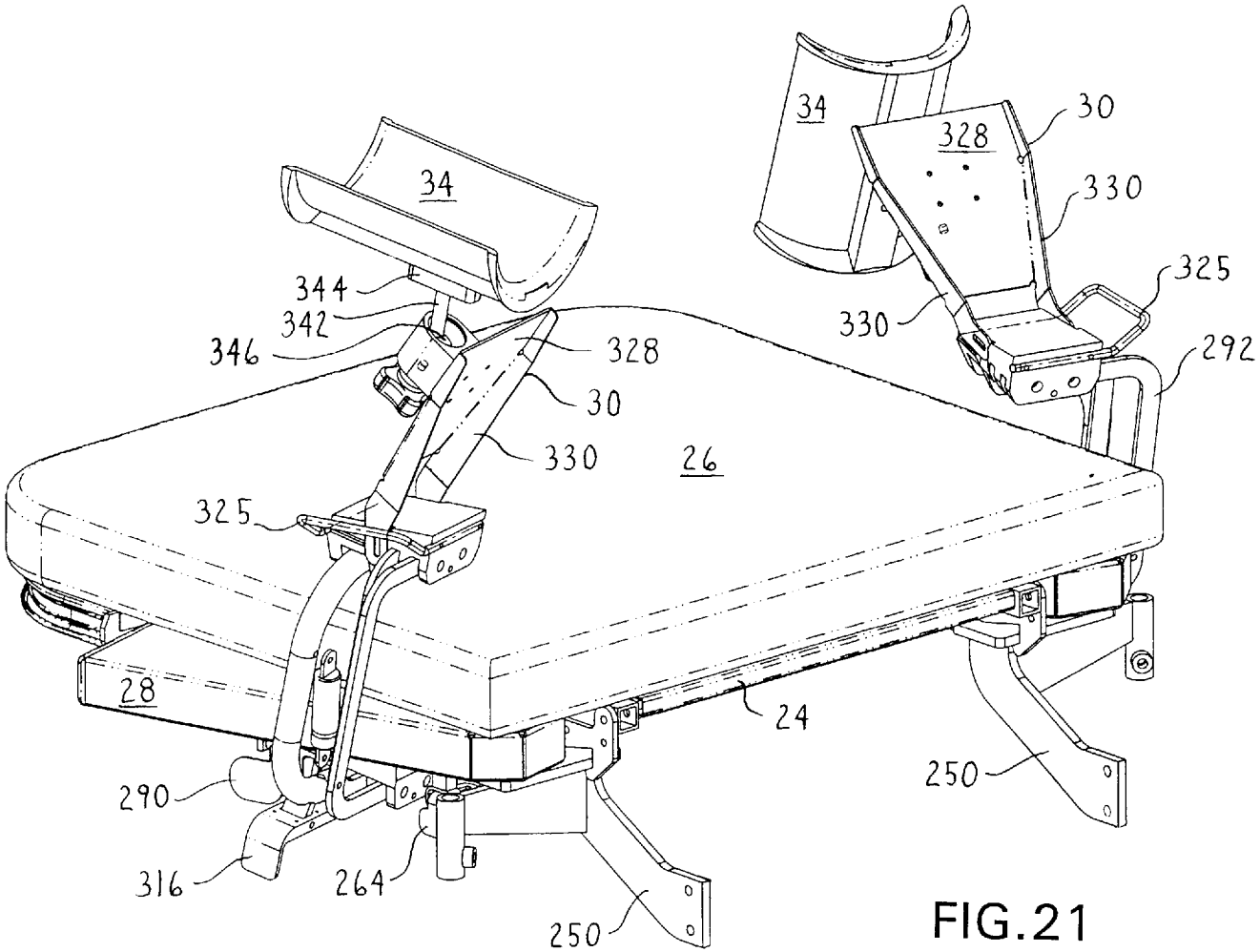
FIG. 21 is a side view of the foot-and-leg section of the bed of this invention illustrating how the foot rest and leg rest are positioned for use.
Figure 22:
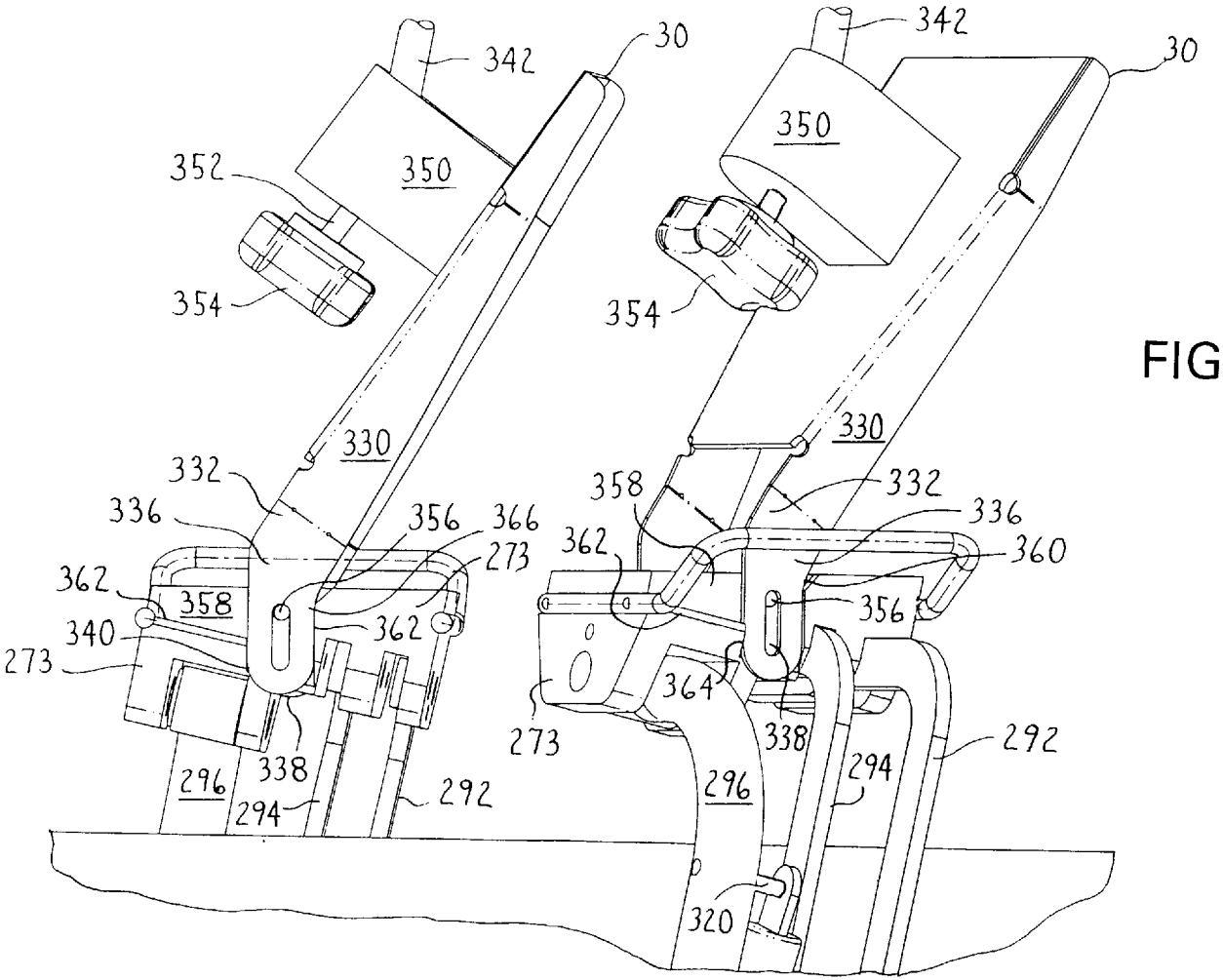
FIG. 22 is a detailed view illustrating how the foot rest-leg rest sub-assembly are adjustably attached to the linkage assembly to which it is connected.

As illustrated in FIGS. 21 and 22, each foot rest 30 is formed out of a single piece of selectively shaped metal. The foot rest has a relatively wide, flat base section 328 on which the woman places her foot. Base section 328 is shaped to have an increasing width so as to be narrow along the end thereof the woman rests her heel and wider along and along the end thereof she places the ball of her foot. A rubber or plastic cover, (not illustrated), is typically placed over the foot rest base section 328 and adjacent sections of the foot rest 30 for both comfort and aesthetic purposes. Extending upwardly from the longitudinal edges of the base section 328 are opposed side sections 330.

Integral with each foot rest side section 330 is a mounting tab 332 that extends rearward of the heel end of the base section 330. Each mounting tab 332 has a stem section, (not identified) that is closest to the foot rest section 330 and extends in-line with the side section 334. Extending diagonally away from the tab stem section is an end section 336. Mounting tab 332 is formed so that end section 336 defines both an elongated slot 338 that extends along the length of the section 336 and an end tip 340 with a semi-circular outer surface. As discussed hereinafter, slot 338 and curved end tip 340 facilitate positioning of foot rest 30 so that either foot rest 30 or leg rest 34 can be locked in position for use.

Leg rest 34 is adjustably secured to the undersurface of the foot rest base section 330. The leg rest 34 is an elongated semi-circular structure formed out of reinforced plastic and designed to hold the thigh section of a woman's leg in position during delivery. A mounting post 342 is attached to a mounting plate 344 secured to the outer surface of the leg rest 34 so as to extend away from the leg rest. A ball 346 is attached to the distal end of the mounting post 342. The ball 346 is disposed in a complementary ball socket 348 defined by a mounting block 350 secured to the undersurface of the foot rest base section 330. A set screw 352 is seated in a complementary threaded bore, (not illustrated,) formed in the mounting block to facilitate the locking of the leg rest 34 in the appropriate position. Set screw 352 is selectively tightened and loosened by an handle 354 attached to the exposed end of the screw.

The foot rest 30-leg rest 34 sub-assembly is adjustably secured over the top surface of the brace block 273. The opposed foot rest mounting tabs 332 are positioned to be located over the opposed sides of the brace block 273. Foot rest 30 is secured to brace block 273 by pins 356 formed integrally with the brace block that extend outwardly therefrom into the slots 338 formed in the foot rest mounting tabs 332. Brace block 273 is further formed so that the sides thereof each have an inwardly recessed upper front surface 358. Surface 358 is positioned to define a first vertically oriented step 360 adjacent the middle of the brace block 273 that extends across the width of the base block and a horizontal oriented step 362 that extends approximately one-third back from the front edge of the base block along the middle of the block. Surface 358 further defines a second vertically oriented step 364 that extends downwardly from the end of horizontally oriented step 362. First and second vertical steps 360 and 364, respectively, are spaced apart form each other to define a seating channel 366 in which the end section 336 of the foot rest mounting tab 332 can be positioned. Pin 356 is positioned to extend outward from a point on surface 358 above horizontally oriented step 362 that is aligned with the longitudinal axis of channel 366.

When the woman using the bed 10 of this invention requires the foot rests 30, the mounting tabs 332 are positioned so that the tab end sections 336 are seated on the horizontally oriented steps 362. When the mounting tabs are so positioned, the base sections 328 of the foot rests 30 extend diagonally upwards so that the woman can place her feet in them. When use of the leg rests 34 is required, the foot rests 30 are lifted upwardly and pivoted around pins 356 so that the end sections 336 are aligned with the channels 366. Foot rests 30 are then moved downwardly so that the mounting tabs 332 are seated in the channels 366. Once the mounting tabs 332 are so positioned, the tabs lock the foot rests 30 in position so that foot rests 30 are slightly forward of the full vertical. When foot rests 30 are in this position, leg rests 34 are in the proper orientation that allows their use.

Figure 16:
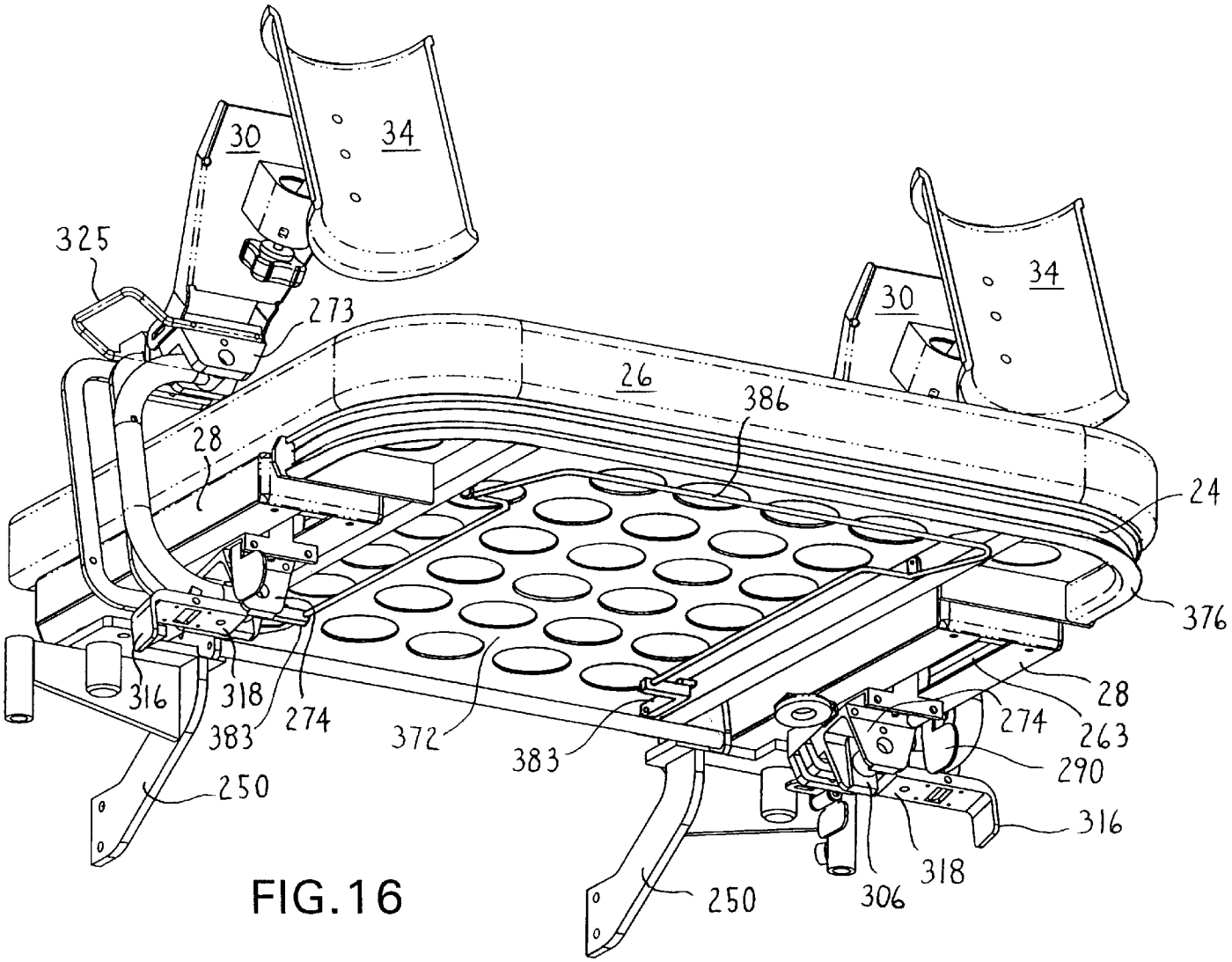
FIG. 16 is an upwardly oriented view illustrating the undersurfaces of the foot frame and foot pan.

Foot frame 24, now described with reference to FIGS. 14 and 16, has a generally flat metal skin 372 that is normally substantially located between the foot pans 28. The end portion of the foot frame 24, the portion located distal to the end of the litter frame 12, extends beyond the ends of the foot pans 28. The end portion of the foot frame 28 is further shaped to form two opposed wing sections 373 that abut the ends of the foot pans 28. Structural strength to support the lower mattress 26 and the portions of the woman's body resting thereon is provided by beams 374 that extend underneath the outer perimeter of frame skin 372.

Guide fingers 376 attached to the opposed sides of he foot frame 28 adjacent the litter frame to facilitate securing the frame 28 to the rest of the bed 10. Guide fingers are secured to the adjacent outer surfaces of the beams 374 so as to extend along an axis parallel to that of the adjacent beam. Each guide finger 376 is shaped to have a rectangular cross-sectional profile and is further dimensioned to be secured into the elongated rails 253 integral with foot pan uprights 250. A pyramidal shaped tip 378 formed of low friction plastic projects forward of the open front end of each guide finger 376. The tips 378 facilitate the centering of the fingers 376 in the sockets 256.

A generally L-shaped load plate 380 is secured each side of the foot frame immediately behind each guide finger 376. Each load plate 380 is positioned so that the relatively short, vertically oriented portion thereof is welded or otherwise permanently secured to the adjacent surface of the foot frame beam 374. The plate 380 is oriented so that the relatively long, horizontally oriented portion thereof extends over the adjacent foot pan 28. Collectively, load plates 380 transfer a portion of the load placed on the foot frame 24 to the adjacent foot pans 28.

Foot frame 24 is releaseably secured to the rest of the bed 10 of this invention by lock pins 382, one shown, fitted in the ends of the adjacent beams 374. Each lock pin 382 is normally biased by a latch assembly 383 to extend perpendicularly outward, along an axis perpendicular to the longitudinal axis of the bed. In the illustrated portion of the invention, the adjacent guide finger 376 is formed with a notch 377 in which the lock pin 382 is normally seated. The lock pin 382 also normally projects into a complementary notch 384 formed coincidentally in the adjacent receiving rail 253. Latch assembly 383 is actuated by a handle 386 pivotally secured to the underside of the foot end of the foot frame 28. The actuation of handle 386 causes latch assemblies 383 to retract lock pins 382 into the frame beam 374. This allows the foot frame to be removed from the rest of the bed 10 with a relatively simple backwards pulling motion.

The upper mattress 20 that covers the Fowler and seat frames 16 and 18, respectively, is formed from two sections. Mattress 20 has a first Fowler section 388 covers the Fowler frame 16 and a seat section 390 smaller in length covers the seat frame 18 (FIG. 1, sections shown in phantom). Both mattress sections 388 and 390 are encased in separate pockets formed in a single cover 392. Mattress cover 392 is formed with a V-shaped separation 394 between the separate mattress sections 388 and 390 allow for the pivoting and translational movement of the Fowler frame 16. In some preferred version of the invention mattress 20 is approximately five inches thick while lower mattress 26 that covers the foot frame 24 is three inches thick.

The energization of the motors 80, 134, 158, 187 and 240 is controlled by a processing circuit 398 (FIG. 2) attached to the litter frame underneath cover 105. Medical personnel actuates the various bed sub-systems by pressing switches 400 found in the outer face of one of the bed side rails 22. The actuation of the switches send specific command signals to the control unit 398.

Control unit 398, in addition to responding to the generation of manually entered commands, also monitors and responds to the state of the sub-systems forming the bed 10.

The monitoring is performed with the aid of sensors 402 and 405 now described with reference to FIGS. 3 and 3A. Sensor 402 is a scale sensor employed to generate a signal representative of the position of the inner frame 50 and litter frame 12 relative to the bed base 11. Scale sensor 402 includes a potentiometer 406 secured to inner frame rail 52 adjacent cross beam 56*a*. A drive gear 408 is fitted around cross beam 56*a* to rotate in unison with the beam. A driven gear 410 is attached to the wiper of the potentiometer and is positioned to engage the drive gear 408. During the raising and lowering of the litter frame 12, cross beam 56*a* rotates relative to the inner frame 50. The rotation of cross beam 56*a* is transferred through gears 408 and 410 to potentiometer wiper so as to cause a change in the resistance of the potentiometer 406. A signal representative of this change in potentiometer resistance 406 is monitored by processing circuit 398 as being representative of the relative height of the litter frame 12. Scale sensors similar to sensor 402 are employed to monitor the degree to which the Fowler frame 16 is pivoted relative to the seat frame 18 and the relative up-down position of the lift bar 234 to which the foot frame 24 and foot pans 28 are attached.

Sensor 405 is a proximity switch sensor employed to monitor the position of carriage 120 that moves litter frame 12 into and out of the Trendelenburg position. Sensor 405 includes two proximity switches 412*a* and 412*b* that are attached to one of the carriage link arms 126 at spaced apart locations. Sensor 405 also includes a trigger arm 414 securely attached to the adjacent inner frame rail 52 between in the proximity switches. In some versions of the invention, switches 412 are mechanically actuated contact switches and the trigger arm 414 is constructed to physically actuate the switch contact elements. In other versions of the invention, switches 412 are magnetically actuated switches; in these versions of the invention, trigger arm 414 is provided with a magnet that generates a magnetic field of sufficient strength to open and close the switches 412.

When the bed 10 is actuated so as to cause the litter frame 12 to move into the Trendelenburg position, the movement of the carriage 120 brings the switch 412*a* adjacent the head of the bed to a position adjacent the trigger arm 414. When the litter frame 12 is fully pivoted into the Trendelenburg position, the switch 412 is positioned adjacent the trigger arm 414 so that as to cause the switch to change state. The change of the switch state is monitored by the processing circuit 398 and is recognized as an indication that the litter frame 12 has reached its full Trendelenburg position. Once the processing circuit 398 has determined the litter frame 12 has reached this state, the circuit deenergized motor 134. When the litter frame 12 is returned to its normal, horizontal state, the movement of carriage 120 causes switch 412*a* to move away from trigger arm 414 and switch 412*b* to move towards the trigger arm 414. Switch 412*b* is positioned so that when the litter frame 12 is in its normal state, switch 412*b* will be close enough to trigger arm 414 so that state of the switch will be changed. This state change of switch 412*b* is likewise monitored by the processing circuit 398 in order to determine when motor 134 should again be deenergized. The Fowler carriage 144 is provided with a proximity switch sensor similar to sensor 405 so that the processing circuit 398 can monitor the position of carriage 144.

The actual energization currents applied to the motors 80, 134, 58, 187 and 240 supplied to the motors from an external source through a set of relays 404. The relays 404, which are located next to the control unit 398, are controlled by the signals generated by the control unit.

When an expectant mother is ready to deliver her child on the bed 10 of this invention, the appropriate switch 400 is depressed so as to cause lift assembly 14 to lower the litter frame 12 to a relatively low position adjacent to the underlying floor surface. Owing to the relatively large distance between the lift link 70 vertices connected to the stanchions 44 and the vertices connected to the cross bars 56, lift assembly 14 can be employed to move the bed to a relatively low position relative to the base and floor surface propose to facilitate the moments lying on the litter frame. For example, in one preferred version of this invention the litter frame 12 can be moved between a position wherein the Fowler and seat frames 16 and 18, respectively, are as little as 17 inches above floor level to a raised position 37 inches above floor level. Once the woman is on the bed lift assembly 14 is again actuated to raise the litter frame 12.

If, while the woman is lying upon the bed 10, it is necessary to position her body so that her head and chest are below her waist and feet, a second switch 400 can be depressed. The actuation of this switch 400 directs the control unit 398 to actuate motor 134 so as to cause the litter frame 12 to pivot into the Trendelenburg position. If, however, the litter frame 12 is relatively close to the underlying floor surface, there may not be sufficient clearance to so pivot the litter frame. When the bed 10 is in this state, based on the signals generated by sensor 402, control unit 398 will have determined that the litter frame 12 is in a lowered state. If control unit 398 determines that the bed 10 is in this state when a command to pivot the litter frame 12 into the Trendelenburg position is generated, the control unit first actuates the lift assembly motor 80. Motor 80 is energized for a sufficient period to enable the lift assembly 14 to lift the litter frame 12 above the ground a sufficient distance to allow the litter frame to be pivoted. Once litter frame 12 is so lifted, control unit will then energize motor 134 so as to cause the pivoting of the litter frame 12 into the Trendelenburg state. In some preferred versions of this invention, bed 10 is constricted so the lift assembly 14 need only be actuated enough to cause the litter frame 12 to be lifted 3 to 8 inches relative to its lowest position in order to then be able to pivot the litter frame into the Trendelenburg position. In still more preferred versions of the invention, it is necessary to only lift the litter frame 12 approximately 4 inches relative to its lowest position in order to be able to move the frame into the Trendelenburg position.

Once the woman is ready to begin the delivery process, the Fowler section 16 is then positioned in its optimal location for that particular woman. Initially, motor 187 is actuated so as to cause the Fowler section 16 to be pivoted a slight distance above the horizontal.

This pivoting causes the lower edge of the Fowler section 16, this section normally located adjacent the seat section 18 to rotate a slight distance above the seat section. Once the Fowler section 16 has been so displaced, motor 158 can be actuated to move the Fowler section toward the seat end of the litter frame 12. Thus, women of varying physical stature can, with the aid of the pivoting and translating components of the Fowler assembly, be positioned so that their backs are at the best angle to facilitate the necessary delivery and that their birth canals are positioned adjacent the end of the seat frame 18 as is typically required during the birthing process.

If, during the birthing process, a medical condition arises which requires the woman to be rapidly returned to the horizontal, the handle to which clutch cable 228 is attached can be actuated. The actuation of the handle pulls on the cable 228 so as to cause the clutch disengagement plate 224 to pivot toward the head end of the bed 10. The movement of the disengagement plate 224 simultaneously disengage shafts 170 and 202 from the motors 158 and 187, respectively, to which shafts are otherwise normally attached. The disengagement of the shafts 170 and 202 allow the Fowler frame 16 to be both rapidly moved rearwardly and pivoted downwardly so the frame 16 will returned to its normal, horizontal state. The rapid return of the Fowler frame 16 to its normal state is further facilitated by the action of the spring loaded biasing rods 173. The rods 173 rapidly force the Fowler frame carriage 120 forward so as to ensure that, as the Fowler frame 18 pivots downwards, it is spaced from the adjacent seat frame 18.

During the birthing process, the mother is required to brace herself between the Fowler frame 16 and the foot rests 30. The foot rests 30 are placed into position by pivoting the linkages 32 to which the rests 32 are attached upwards. Since the foot rests 30 are normally suspended underneath the foot pans 28, the pivoting and proper positioning of foot rests into position is a simple one-handed act done in a minimal amount of time that, moreover, does not require the woman's legs to be disturbed.

When, at a later stage of the birthing process it is desirable to place the woman's legs in the leg rests 34, the leg rests are put into position by simply pivoting the foot rest 30. In order to ensure that the woman's legs are seated in the leg rests 34, motor 240 is actuated to lower the foot pans 28 on which the foot rests 30-leg rests 34 sub-assemblies are carried.

When, during delivery it finally becomes necessary for medical personnel to position themselves adjacent the woman's birth canal, foot frame 24 is removed by initially pressing upwards on the handle 386. The movement of the handle 386 causes the lock pins 382 to retract away from the receiving rolls 253. Foot frame 24 is then removed by simply pulling it away from rest of the bed 10.

Bed 10 of this invention has both a motorized lift assembly and second assembly for selectively moving the bed into the Trendelenburg position. Consequently, medical personnel attending to the needs of the expectant mother on the bed need do nothing more than actuate appropriate switches 400 in order to move the bed into the proper position. This frees the medical personnel to attend to the other needs of the woman. Moreover, when the litter frame 12 is in the relatively low position and it is necessary to move the bed into the Trendelenburg state, control unit 298 automatically raise the litter frame 12 the few inches it needs to be raised in order to allow the litter frame to be properly positioned. Thus, if during the delivery it is necessary to move the bed into the Trendelenburg position it can be done so relatively rapidly.

Owing to the adjustable nature of the Fowler frame 16 and the fact that the foot rests 30 can be moved along the length of the foot pans 28 the bed 10 of this invention is well suited to facilitate the birthing process of women of varying shapes and sizes. If, during the delivery it is necessary to rapidly restore the woman to a horizontal position the actuation of the clutch assembly and the cooperation of the biasing rods 173 ensure that the bed will be quickly returned to its initial state. Moreover, since the foot rests 30 are suspended below the foot pans 28, the rests 28 can easily be moved back to their stored state without having to disturb the lower body of the woman on the bed 10. Likewise, since the leg rests 34 are attached to the foot rests 30 there is no likelihood these components can be lost or that significant time will be spent moving the leg rests into position. In sum, the maternity bed 10 of this invention is both readily useable by woman of different shapes and sizes requires the minimal attention of the medical personnel attending to that women that use it.

Figure 23B:
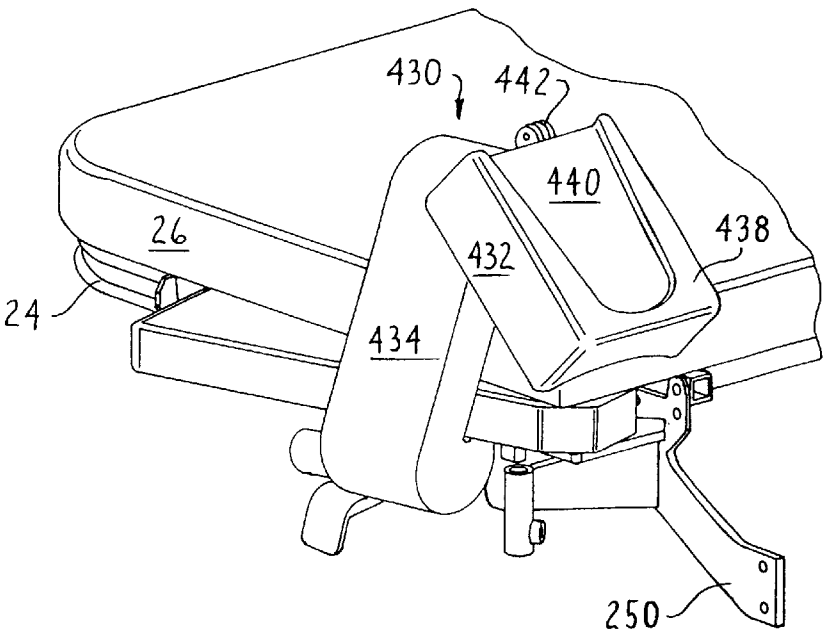
FIGS. 23A and 23B are perspective views of an alternative leg rest-foot rest sub-assembly of this invention.
Figure 23A:
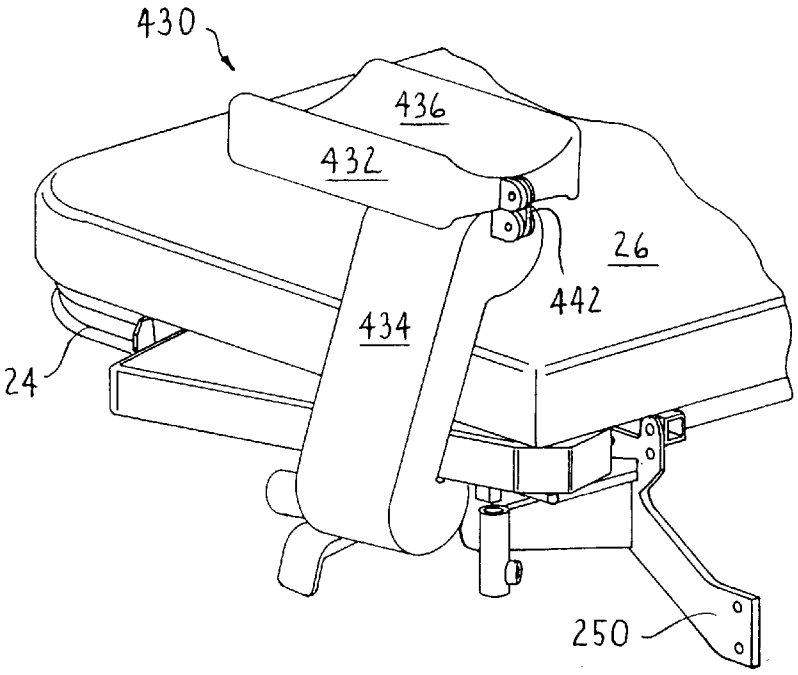

FIGS. 23A and 23B illustrate an alternative foot rest-leg rest assembly 430 that can be employed with the bed 10 of this invention. Assembly 430 has a rest brace 432 which is attached to the bed foot pan 28 by a linkage assembly 434 similar, if not identical to, previously described linkage assembly 32. Rest brace 432 has an upper surface 436 shaped to have inwardly curved, semicircular profile so as to allow this portion of the brace to serve as the leg rest. Rest brace 432 has an undersurface 438 shaped to define a foot pad 440.

Rest brace 432 is secured to the linkage assembly by a hinge assembly 442 that is directed toward the head end of the bed 10. When rest brace 432 is its upright position, the brace undersurface 438 is located adjacent the linkage assembly 434 and the upper surface is exposed. The foot pad 440 is exposed by pivoting the rest brace 432 around the point to which the brace is connected to the linkage assembly 434. When the rest brace 432 is so pivoted, it extends diagonally downward and forward relative to the linkage assembly 434. When the rest brace 432 is in this position, the foot pad 440 of the brace is exposed and positioned to receive the foot of the woman using the bed 10.

When assembly 430 is in the stowed position, linkage assembly 434 holds the rest brace 432 in the upright state below the foot pan 28. When use of either the leg rest or foot rest is required, linkage assembly 434 is moved outwardly to lock the rest brace 432 into position above the lower mattress 26. Initially, when the brace 432 is in this state, the leg rest is available for use. The foot pad 440 is moved into position by pivoting the rest brace 432 downwards.

It should be recognized the foregoing description of the bed 10 of this invention is for the purposes of illustration only. It will be apparent, however, from the description of the invention that it can be practiced using alternative components other than what has been specifically described. For example lift assembly 14 is not the only type of lift assembly used to raise the litter frame 12 relative to the bed base 11. In some versions of the invention one or more rigid lever arms may be employed to raise and lower the litter frame 12. Alternatively, it may be desirable to replace the illustrated triangular lift links 70 with two three-sided weldments. Each weldment is formed to have two aligned lift legs that are rigidly attached to a cross tube. The free ends of the weldment lift legs are attached to the end sections 46 of the stanchions 44. The rails 52 forming the inner frame 50 would be secured for rotation to the weldment cross tubes. The motor 80, while mounted to the litter frame 12, is coupled to the cross tube of one of the weldments so as to displace the weldment. The weldments themselves are connected by a drag link so that the actuation of the motor 80 causes the weldments to engage in a pantograph up-and-down motion that raises and lowers the inner frame 50 and the litter frame 12. An advantage of this arrangement is that the drag link that connects the weldments together can easily be disposed inside the litter frame 12. This eliminates the need to provide cross beams outside of the litter frame and the external pinch points that these beams, in combination with their associated lift links, would create.

Figure 24:
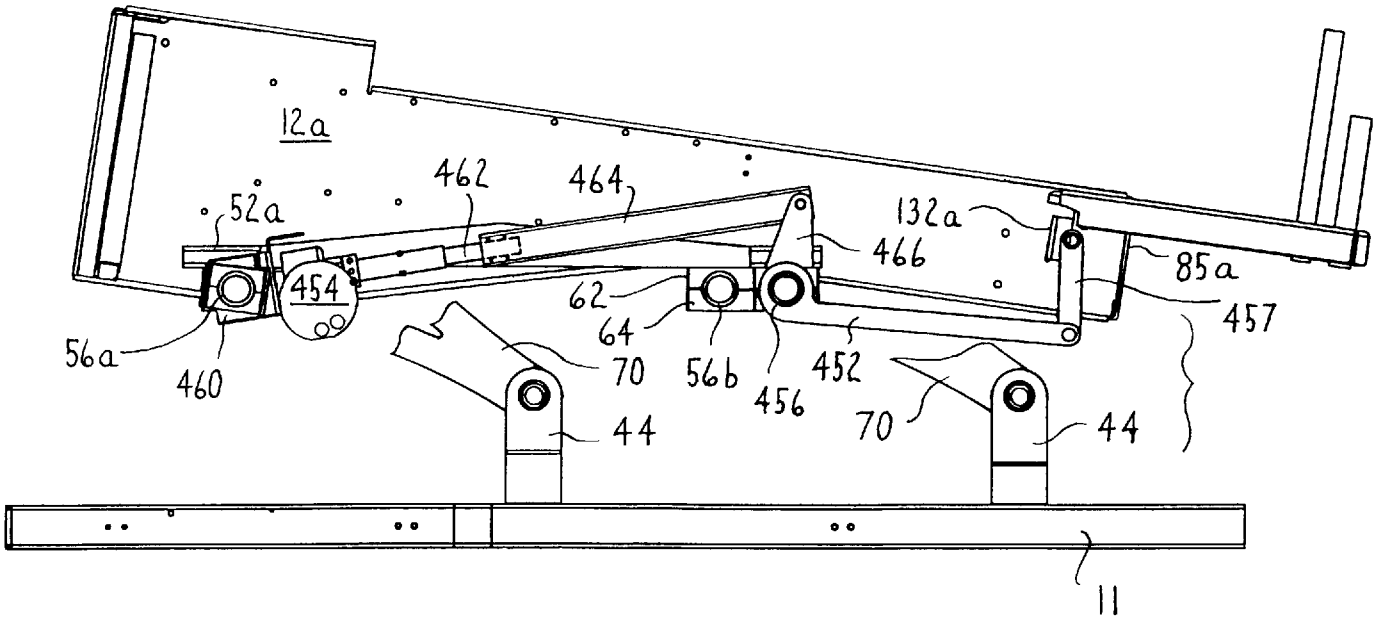
FIG. 24 is a perspective, cut away view of depicting an alternative assembly for pivoting the litter frame relative to the inner frame according to this invention.
Figure 25:
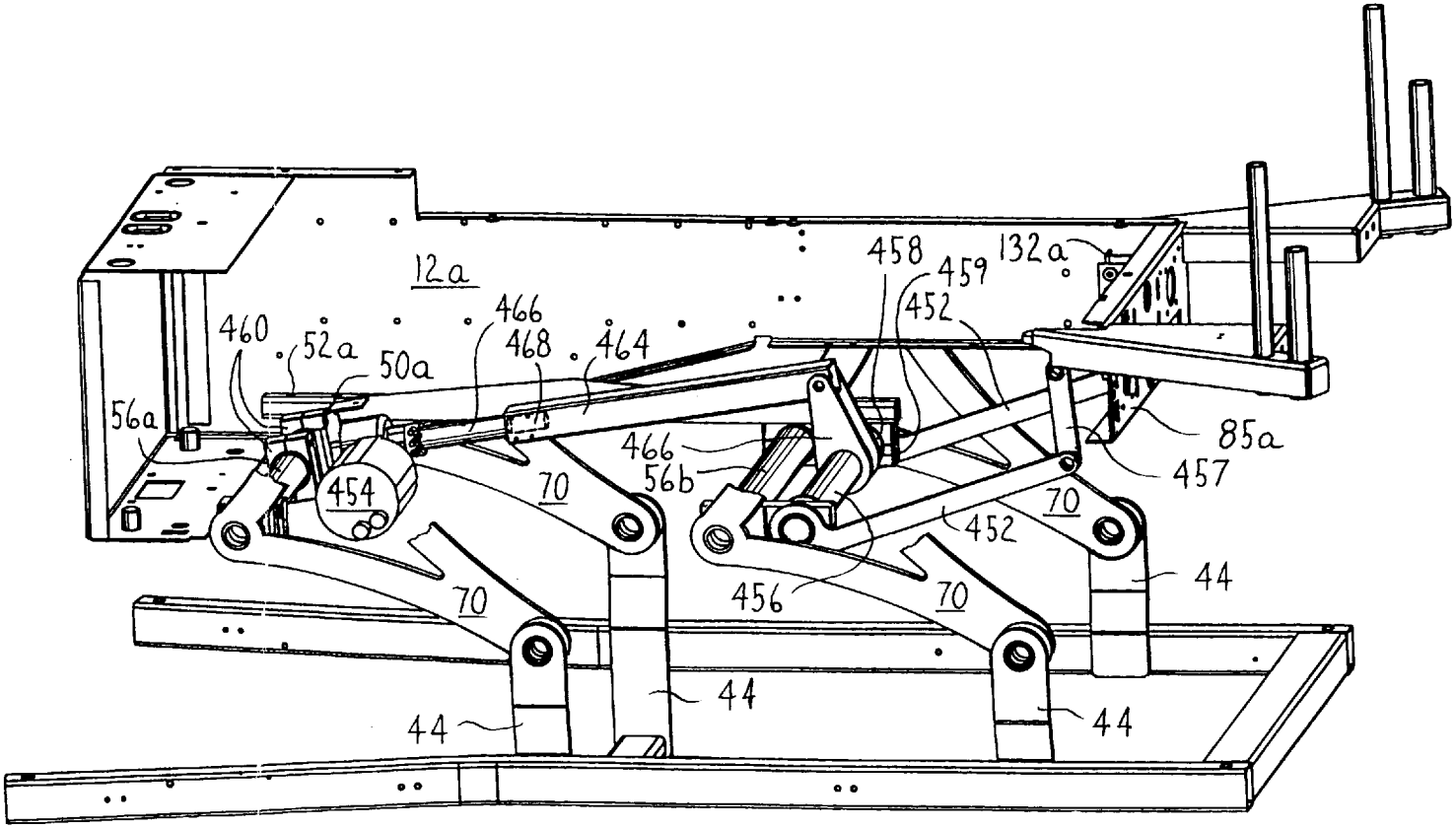
FIG. 25 depicts how the litter frame is pivoted into a head-down, or Trendelenberg position with the assembly depicted in FIG. 24.

Moreover, other devices may be used to pivot the litter frame 12*a* relative to the inner frame 50*a*. As seen in FIGS. 24 and 25, in some versions of the invention, a pivoting arm 452 fixed at one end to inner frame 50*a* may be employed to rotate the litter frame 12*a* downwardly. Arm 452 is attached to a motor 454 that actuates it. In the illustrated alternative version of the bed 10*a,* two arms 452 are provided. One end of each arm 452 is attached to an end of a tubular Trendelenburg weldment 456. The Trendelenberg weldment 456 is fitted in blocks 458 and 459 that are secured to the bottom of the rails 52*a* forming inner frame 50*a*. Blocks 458 and 459 are similar in design to previously described blocks 62 and 64 so as to allow the Trendelenberg weldment 456 to rotate. One end of a follower link 457 is attached to the end of each arm 452 distal from the Trendelenberg weldment 456. The opposed end of each follower link 457 is attached to a mounting block 132*a* integral with the litter frame 12*a* so as to extend downwardly from the litter frame.

Motor 454 is pivotally connected to the cross beam 56*a* of the inner frame 50*a* by a set of mounting blocks 460. The motor 454 is a right-angle motor having a shaft 462 that is directed generally towards the head end of the litter frame 12*a*. The free end of shaft 462 is fitted in a rectangular drive tube 464. The end of the drive tube 464 distal from shaft 462 is secured to two arms 466 integral with Trendelenberg weldment 456 that collectively form a bell crank. The end of the drive tube 464 in which the shaft 462 is seated is provided with a threaded member 468, (shown in phantom), that is engaged by the shaft 462. Consequently, the rotation of the shaft 462 by motor 454 causes forward and reverse movement of the drive tube 464 relative to the head end 85*a* of the litter frame 12*a*.

Arms 452 and follower links 457 cooperate to support the head end 85*a* of the litter frame 12*a*. When the Trendelenberg weldment 456 is positioned so that the arms 452 extend diagonally upwardly, the head end 85*a* of the litter frame 12*a* is in its upright position and the litter frame 12*a* itself is in a horizontal orientation. When it is necessary to place the litter frame 12*a* in the Trendelenberg position, motor 454 is actuated so as to move drive tube 464 toward the head end 85*a* of the litter frame 12*a*. The resultant rotation of the Trendelenberg weldment 456 caused by the displacement of the drive tube 464 pivots arms 452 downwardly. As seen best in FIG. 25, the downward movement of the arms 452 causes a like movement of the head end 85*a* of the litter frame 12*a* so as to place the litter frame in the Trendelenberg position.

It should be recognized that in this version of the invention the previously described control unit 398 is employed to regulate the actuation of the motor 80 that controls the raising and lowering of the inner frame 50*a* and the litter frame 12*a* and the motor 454 that controls the pivoting of the litter frame 12*a*. If, for example, a switch 400 is depressed to place the bed 10*a* in the Trendlenburg position and the litter frame 12*a* is too close to the base, motor 80 is initially actuated to raise the inner frame 50*a* and the litter frame 12*a* a relative small distance above the base 11. Once the litter frame 12*a* has been so displaced, control unit 398 causes the actuation of motor 454 so as to cause the pivoting of the litter frame 12*a* into the Trendelenburg position.

Still in other versions of the invention, the Fowler frame 16 and associated assembly may be constructed so that a motor is directly connected to the Fowler frame to pivot the frame between the horizontal and inclined positions. In these versions of the invention, it may then be desirable to attach the motor to the translating assembly to which the Fowler frame 16 is attached.

Furthermore, other devices than the disclosed gear sensors 402 may be used to monitor the state of various individual step components that of this invention. For instance, in some versions of the invention, a potentiometer wiper may be attached to one component, for example, the Fowler frame cam follower 174 while the body of the potentiometer is attached to the Fowler carriage 144 in order to provide an indication of the inclined state of the Fowler frame 16. Similarly, contact switches may be employed to generate signals indicating whether or not particular components of the bed are in their fully extended or retracted state. For example, contact switches may be attached to the Fowler carriage 144 in order to indicate whether or not the carriage is in its fully forward and/or fully rearward positions. The described embodiment of the bed 10 of this invention has five electric motors, each of which has drive shaft and linkage associated therewith. In other embodiments of the invention, one, some or all of the motors may be different from what has been described. For example, it may be desirable to employ hydraulically driven actuators for raising and lowering the litter frame 12.

Also, there is no need to always employ the mounting boss 258 and guide pin 260 for holding the foot pan 28 in place. In some versions of the invention, it may be desirable to provide the foot pan with a sleeve that fits over a mounting boss associated with the fixture plate 254. A compression bolt fitted in the sleeve is then tightened against the boss to hold the foot pan in position. An advantage of this arrangement is that it allows small, incremental movements of the foot pan 28 and further can be constructed to allow the vertical position of the foot pan 28 to be set relative to the fixture plate 254

It should similarly be understood that the linkage assemblies used to secure the foot rests 30 to the foot pans 28 may be different from what has been disclosed. For example, the disclosed foot pan carriages may be eliminated and solid blocks that are seated in the foot pans 28 may be substituted therefore. In this version of the invention, these blocks would have wing sections that extend over the inner surfaces of metal forming the foot pans that defines the rectangular slots 263. Strips of low friction plastic material may be attached to these surfaces of the foot pans 28 so as to provide a reduced friction interface between the solid blocks and the foot pans. This arrangement may be desirable for reducing some of the loose movement medical personnel may feel when they are portioning the wheeled carriage.

Moreover, it should also be understood while the bed 10 of this invention has been described primarily for use in a maternity bed to facilitate delivery of a child, it should be recognized that the bed as well as its individual sub-assemblies can have other applications. Clearly various sub-assemblies that form this bed can be incorporated into other hospital beds for use which facilitate the well being of the patient resting on a bed and/or to reduce the work load of the medical personnel attending those individuals. Therefore, it is an object of the appended claims to cover all such modifications and variations that come within the true spirit and scope of the invention.

The embodiments of the invention in which an exclusive property or privilege is claimed are defined as follows:

1. A hospital bed including:

a base;

an inner frame positioned over said base, said inner frame having opposed ends, a longitudinal axis that extends between said inner frame ends and two cross beams, each said cross beam located adjacent a separate said end of said inner frame and extending perpendicularly across the longitudinal axis of said inner frame;

a lift assembly connected between said base and said cross beams for vertically positioning said inner frame a distance above said base, said lift assembly having a lift assembly motor for actuating said lift assembly;

a litter frame disposed over said inner frame having opposed ends, a longitudinal axis that extends between said litter frame ends, two side walls located on opposite sides of the longitudinal axis and wherein said side walls at a first end of said litter frame are pivotally attached to a first said cross beam and a second end of said litter frame is movable relative to a second said cross beam; and a pivot assembly including: a rotating shaft attached to said inner frame so as to extend perpendicularly across the longitudinal axis of said litter frame; two spaced-apart parallel arms extending from said shaft that rotate with said shaft; two lift links, each said lift link being pivotally attached at one end to said second end of said litter frame so as to extend downwardly therefrom and at a second end to a separate one of said arms, wherein said arms and said lift links cooperate to support said second end of said litter frame and said lift links are attached to said litter frame on opposed sides of the longitudinal axis of said litter frame; and a pivot assembly motor connected to said rotating shaft to rotate said shaft so as to cause the inclination of said second end of said litter frame.

2. The lift assembly of claim 1 further including:

a plurality of manually actuatable switches for controlling said lift assembly and said pivot assembly, each said switch configured to generate a command signal in response to actuation of said switch;

a lift assembly sensor connected to at least one of said base, said lift assembly, said inner frame or said litter frame for monitoring the distance between said inner frame and said base, said lift assembly sensor being configured to generate a signal representative of the distance between said inner frame and said base; and a control unit configured to receive said command signals from said switches, said lift assembly sensor signal and to actuate said lift assembly motor and said pivot assembly motor, said control unit being configured to actuate said motors in response to said command signals and so that when one of said switches is actuated to incline said litter frame and said inner frame is below a selected height, said control unit first actuates said lift assembly motor so as to cause said lift assembly to raise said litter frame above a predetermined height and then actuates said pivot assembly motor so as to cause said litter frame to be inclined.

3. The hospital bed of claim 2, wherein:

said lift assembly is configured to move said inner frame and said litter frame from a first position wherein said litter frame is located a minimum position above said base and a second position wherein said litter frame is located a maximum position above said base; and said control unit is configured to actuate said lift assembly motor to raise said inner frame to a predetermined height in order to pivot said litter frame that is less than said litter frame second position height.

4. The hospital bed of claim 1, wherein: said inner frame includes at least one rail that extends parallel to said longitudinal axis of said inner frame wherein said at least one rail is secured to said cross beams and said rotating shaft is rotatable mounted to said at least one rail.

5. The hospital bed of claim 1, wherein: said pivot assembly motor is pivotally connected to said inner frame.

6. The hospital bed of claim 1, wherein said pivot assembly motor is connected to said rotating shaft through a drive tube, said pivot assembly motor being connected to longitudinally displace said drive tube, and said drive tube is connected to said rotating shaft so as to causing rotation of said shaft with the longitudinal displacement of said drive tube.

7. The hospital bed of claim 6, wherein: said pivot assembly motor is pivotally connected to said inner frame.

8. A hospital bed including:

a base;

an inner frame positioned over said base, said inner frame having opposed ends, a longitudinal axis that extends between said inner frame ends, first and second cross beams, each said cross beam located adjacent a separate said end of said inner frame and extending perpendicularly across the longitudinal axis of said inner frame;

a lift assembly connected between said base and said cross beams for vertically positioning said inner frame a distance above said base, said lift assembly having a lift assembly motor for actuating said lift assembly;

a litter frame disposed over said inner frame having opposed ends, a longitudinal axis that extends between said litter frame ends, and two side walls located on opposite sides of the longitudinal axis wherein said side walls at a first end of said litter frame are pivotally attached to said first cross beam and a second end of said litter frame extends over said second cross beam and are moveable relative to said second cross beam; and a pivot assembly including:

a rotating shaft attached to said inner frame so as to extend perpendicularly across the longitudinal axis of said litter frame, said rotating shaft being located adjacent said second cross beam;

a pivot assembly motor that is pivotally connected to said first cross beam, said pivot assembly motor being connected to a drive tube that is actuated in response actuation of said pivot assembly motor, said drive tube being pivotally connected to said rotating shaft for rotating said shaft in response to the actuation of said pivot assembly motor;

two spaced-apart, parallel pivot arms securely attached to said rotating shaft to rotate with said shaft, said pivot arms being attached to said rotating shaft on opposite sides of the longitudinal axis of the litter frame; and two lift links, each said lift link being pivotally attached at one end to said second end of said litter frame so as to extend downwardly therefrom, said lift links being located on opposed sides of the longitudinal axis of said litter frame, and each said lift link being pivotally attached at a second end to a separate one of said pivot arms so that said pivot arms and said lift links cooperate to support said second end of said litter frame and incline said second end of said litter frame upon actuation of said rotating shaft.

9. The bed of claim 8, wherein: said inner frame includes at least one rail that extends between said ends of said inner frame; and said rotating shaft is connected to said at least one rail.

10. The lift assembly of claim 8, further including:

a plurality of manually actuatable switches for controlling said lift assembly and said pivot assembly, each said switch configured to generate a command signal in response to actuation of said switch;

a lift assembly sensor connected to at least one of said base, said lift assembly, said inner frame or said litter frame for monitoring said distance between said inner frame and said base, said lift assembly sensor being configured to generate a signal representative of said distance between said inner frame and said base; and a control unit configured to receive said command signals from said switches, said lift assembly sensor signal and to actuate said lift assembly motor and said pivot assembly motor, said control unit being configured to actuate said motors in response to said command signals and so that when one of said switches is actuated to incline said litter frame and said inner frame is below a selected height, said control unit first actuates said lift assembly motor so as to cause said lift assembly to raise said litter frame above a predetermined height and then actuates said pivot assembly motor so as to cause said lift frame to be inclined, wherein said predetermined height is less than a maximum position of said litter frame above said base.

11. A hospital bed including:

a base;

an inner frame positioned over said base, said inner frame having opposed ends and a longitudinal axis that extends between said inner frame ends;

a lift assembly connected between said base and said inner frame for vertically positioning said inner frame a distance above said base, said lift assembly including a lift assembly motor for actuating said lift assembly;

a litter frame disposed over said inner frame and being attached to said inner frame so as move vertically with the vertical displacement of said inner frame, said litter frame having two opposed end sections, each said litter frame end section being located adjacent a separate one of said inner frame ends, wherein a first said end of said litter frame is pivotally connected to said inner frame; and a pivot assembly for connecting said litter frame to said inner frame, said pivot assembly including: a pivot arm that extends between said inner frame and a second said end of said litter frame, said pivot arm being moveable between two spaced-apart locations along the longitudinal axis of said inner frame so as to incline said litter frame relative to said inner frame; and a pivot assembly motor connected to said pivot arm for displacing said pivot arm along said inner frame so as to cause the inclination of said litter frame.

12. The lift assembly of claim 11, further including:

a plurality of manually actuatable switches for controlling said lift assembly and said pivot assembly, each said switch configured to generate a command signal in response to actuation of said switch;

a lift assembly sensor connected to at least one of said base, said lift assembly, said inner frame or said litter frame for monitoring the distance between said inner frame and said base, said lift assembly sensor being configured to generate a signal representative of the distance between said inner frame and said base; and a control unit configured to receive said command signals from said switches, said lift assembly sensor signal and to actuate said lift assembly motor and said pivot assembly motor, said control unit being configured to actuate said motors in response to said command signals and so that when one of said switches is actuated to incline said litter frame and said inner frame is below a selected height, said control unit first actuates said lift assembly motor so as to cause said litter assembly to raise said litter frame above a predetermined height and then actuates said pivot assembly motor so as to cause said lift frame to be inclined.

13. The hospital bed of claim 11, wherein:

said inner frame includes at least one rail that extends parallel to said longitudinal axis of said inner frame; and said pivot assembly includes a carriage coupled to said at least one inner frame rail so as to move along said longitudinal axis of said inner frame and said pivot assembly motor is coupled to said carriage for displacing said carriage along said rail and said pivot arm is pivotally connected at one end to said carriage and at the other end to said litter frame.

14. The hospital bed of claim 11, wherein said lift assembly includes two lift links, each said lift link being connected to said base at longitudinally spaced apart positions along said base and being connected to said inner frame at longitudinally spaced apart positions, and said lift links are connected to said base and to said inner frame for raising and lower said inner frame and said litter frame relative to said base.

15. A hospital bed including:

a base having opposed end sections;

an inner frame positioned over said base;

a lift assembly connected between said base and said inner frame for vertically positioning said inner frame a distance above said base, said lift assembly including a lift assembly motor for actuating said lift assembly;

a litter frame disposed over said inner frame and being attached to said inner frame so as move vertically with the vertical displacement of said inner frame, said litter frame having two opposed end sections, each said litter frame end section being located adjacent a separate one of said base end sections;

a pivot assembly for connecting said litter frame to said inner frame so as to be able to selectively pivot said litter frame relative to said inner frame, said pivot assembly including a pivot assembly motor for selectively pivoting said litter frame into a selected position;

a plurality of manually actuatable switches for controlling said lift assembly and said pivot assembly, each said switch configured to generate a command signal in response to actuation of said switch;

a lift assembly sensor connected to at least one of said base, said lift assembly, said inner frame or said litter frame for monitoring the distance between said inner frame and said base, said lift assembly sensor being configured to generate a signal representative of the distance between said inner frame and said base; and a control unit configured to receive said command signals from said switches, said lift assembly sensor signal and to actuate said lift assembly motor and said pivot assembly motor, said control unit being configured to actuate said motors in response to said command signals and so that when one of said switches is actuated to pivot said litter frame and said inner frame is below a selected height, said control unit first actuates said lift assembly motor so as to cause said lift assembly to raise said litter frame above a predetermined height and then actuates said pivot assembly motor so as to cause said litter frame to be so pivoted.

16. The hospital bed of claim 15, wherein: said pivot assembly includes a pivot arm connected between said inner frame and said litter frame for pivoting said litter frame; and said pivot assembly motor is connected to said pivot arm through a drive tube, said motor being connected to longitudinally displace said drive tube and said drive tube is connected to said pivot arm so as to causing a pivoting movement of said at least one pivot arm with the longitudinal displacement of said drive tube.

17. A bed comprising:

a base;

an inner frame positioned over said base;

a lift assembly connected between said base and said inner frame for vertically positioning said inner frame a distance above said base;

a litter frame disposed over said inner frame and connected to said inner frame so as to move vertically with the vertical positioning of said inner frame, said litter frame having first and second spaced apart ends, said first end being pivotally connected to said inner frame; and a linkage assembly extending between said inner frame and said second end of said litter frame, said linkage assembly including: a carriage that is mounted to said inner frame so as to move longitudinally along said inner frame; a pivot assembly motor connected to said carriage for controlling the longitudinal position of said carriage along said inner frame; and at least one pivot arm that is pivotally connected at one end to said carriage and at a second end to said litter frame so that the movement of said carriage results in the pivoting of said second end of said litter frame.

18. A bed comprising:

a base;

an inner frame positioned over said base;

a litter frame disposed over said inner frame, said litter frame having first and second spaced-apart ends, said first end being pivotally connected to said inner frame;

a lift assembly connected between said base and said inner frame for vertically moving said inner frame and said litter frame between a first, minimum, distance above said base and a second, maximum distance above said base;

a linkage assembly extending between said inner frame and said second end of said litter frame for connecting said litter frame to said inner frame so that said litter frame can be inclined relative to said inner frame, said linkage assembly including at least one pivot arm that extends from said inner frame and that is connected to said second end of said litter frame and that is pivotally displaced so as to control the inclination of said litter frame and a pivot assembly motor connected to said inner frame and to said at least one pivot arm for selectively pivoting said at least one pivot arm;

a plurality of manually actuatable switches for controlling said lift assembly and said pivot assembly, each said switch configured to generate a command signal in response to actuation of said switch;

a lift assembly sensor connected to at least one of said base, said lift assembly, said inner frame or said litter frame for monitoring said distance between said inner frame and said base, said lift assembly sensor being configured to generate a signal representative of the distance between said inner frame and said base; and a control unit configured to receive said command signals from said switches, said lift assembly sensor signal and to actuate said lift assembly motor and said pivot assembly motor, said control unit being configured to actuate said motors in response to said command signals and so that when one of said switches is actuated to pivot said litter frame and said inner frame is below a selected height, said control unit first actuates said lift assembly motor so as to cause said lift assembly to raise said litter frame above a predetermined height and then actuates said pivot assembly motor so as to cause said lift frame to be inclined, wherein the predetermined height is less than the maximum distance of said litter frame above said base.

19. The hospital bed of claim 18, wherein: said pivot assembly motor is pivotally connected to said inner frame.

* * * * *